US010537896B2

(12) United States Patent
Tsai et al.

(10) Patent No.: US 10,537,896 B2
(45) Date of Patent: Jan. 21, 2020

(54) AUTOFEED PAPER SHREDDER WITH CLIP AND STAPLE REMOVAL

(71) Applicant: AURORA OFFICE EQUIPMENT CO., LTD. SHANGHAI, Shanghai (CN)

(72) Inventors: Chung Shih Tsai, Hawthorne, CA (US); Yung Kang Tso, Shanghai (CN); Guanglong Chen, Shanghai (CN); Bin Zhang, Shanghai (CN)

(73) Assignee: Aurora Office Equipment Co., Ltd. Shanghai, Shanghai (CN)

( * ) Notice: Subject to any disclaimer, the term of this patent is extended or adjusted under 35 U.S.C. 154(b) by 538 days.

(21) Appl. No.: 15/202,437

(22) Filed: Jul. 5, 2016

(65) Prior Publication Data

US 2018/0008987 A1 Jan. 11, 2018

(51) Int. Cl.

| | |
|---|---|
| ***B02C 18/00*** | (2006.01) |
| ***B02C 25/00*** | (2006.01) |
| *B02C 18/16* | (2006.01) |
| *B02C 18/22* | (2006.01) |

(52) U.S. Cl.

CPC ..... *B02C 18/0007* (2013.01); *B02C 25/00* (2013.01); *B02C 2018/003* (2013.01); *B02C 2018/0046* (2013.01); *B02C 2018/164* (2013.01); *B02C 2018/168* (2013.01); *B02C 2018/2208* (2013.01)

(58) Field of Classification Search

CPC ..... B02C 18/2258; B02C 18/0007; B02C 19/0068; B02C 19/0075; B02C 19/0081

USPC ..... 241/224, 222, 28, 225, 34

See application file for complete search history.

(56) References Cited

U.S. PATENT DOCUMENTS

| | | | | |
|---|---|---|---|---|
| 4,817,877 A * | 4/1989 | Itoh | B02C 18/0007 241/225 |
| 4,821,967 A * | 4/1989 | Moriyama | B02C 18/0007 241/223 |
| 5,354,001 A * | 10/1994 | Hasegawa | B02C 18/0007 241/100 |
| 5,400,978 A * | 3/1995 | Strohmeyer | B02C 18/0007 241/166 |
| 7,871,027 B2 * | 1/2011 | Ko | B02C 18/0007 241/100 |

(Continued)

*Primary Examiner* — Faye Francis

(74) *Attorney, Agent, or Firm* — WHGC. P.L.C.; John F. O'Rourke

(57) ABSTRACT

A paper shredder with counter-rotating shredder blades coupled to a shredder motor, including a paper tray having a floor and being shaped to receive paper. The floor has an offset slot therein adjacent to the counter-rotating shredder blades. The engagement wheels partly protrude through floor, adjacent to the offset slot. The engagement wheels frictionally engage paper and turn towards the offset slot to force paper into the shredder blades. Also, a dentate catch disposed in each corner of the paper tray temporarily holds an affixment while a sheet of paper held by the affixment is being frictionally engaged by the engagement wheels to enter the slot for comminution. A PAPER FULL sensor, a DOOR OPEN sensor, an OVERLOAD sensor, an OVER-HEAT sensor, a paper-in-tray sensor, a paper-at-entry sensor, a SAFETY LOCK sensor, and a cover door open/closed sensor are provided, as are AUTO and MANUAL modes of operation.

18 Claims, 26 Drawing Sheets

(56) References Cited

U.S. PATENT DOCUMENTS 8,061,635 B2 * 11/2011 Kim ..... B02C 18/0007 241/225
8,167,223 B2 * 5/2012 Jensen ..... B02C 18/0007 241/100
8,336,792 B2 * 12/2012 Matlin ..... G01F 23/292 241/100
8,403,246 B2 * 3/2013 Seo ..... B02C 18/0007 241/225
8,651,404 B2 * 2/2014 Chang ..... B02C 18/0007 241/100
8,727,255 B2 * 5/2014 Kim ..... B02C 18/0007 241/100
9,440,238 B2 * 9/2016 Pilch ..... B02C 18/0007
2002/0070300 A1 * 6/2002 McLean ..... B02C 18/0007 241/30
2005/0274836 A1 * 12/2005 Chang ..... B02C 18/0007 241/236
2006/0175444 A1 * 8/2006 Chen ..... B02C 18/0007 241/100
2008/0245908 A1 * 10/2008 Romanovich ..... B02C 18/0007 241/33
2010/0032505 A1 * 2/2010 Jensen ..... B02C 18/0007 241/25
2010/0032507 A1 * 2/2010 Chen ..... B02C 18/0007 241/34
2010/0059612 A1 * 3/2010 Huang ..... B02C 18/0007 241/33
2010/0320675 A1 * 12/2010 Kim ..... B02C 18/0007 271/109
2011/0068530 A1 * 3/2011 Ahn ..... B02C 18/0007 271/10.11
2012/0018554 A1 * 1/2012 Seo ..... B02C 18/0007 241/101.2
2012/0187230 A1 * 7/2012 Aries ..... B02C 18/0007 241/30
2014/0263774 A1 * 9/2014 Matlin ..... B02C 18/0007 241/28
2015/0220418 A1 * 8/2015 Aries ..... H04W 4/70 705/40

* cited by examiner

AUTOFEED PAPER SHREDDER WITH CLIP AND STAPLE REMOVAL

BACKGROUND

1. Field of the Invention

The present invention relates to paper shredders and, more particularly, to paper shredders with automatic sheet feeding.

2. Background Art

Paper shredders are useful pieces of machinery for the home, or the office. Most paper shredders have a feed inlet throat, which typically is a horizontal slot in the top of the machine. Below the horizontal slot are shredding blades, coupled to an electric motor. Some machines can be fed a dozen or more sheets of paper in an automatic feeder, which typically is a feeding tray set at an angle to the feeder inlet. Automatic paper feeding is primarily by gravity, with assistance from coaxing wheels disposed on the automatic feeder bin. Often, machines have the capability of shredding embedded staples or attached paper clips. However, over time, this feature leads to dulled or damaged cutting blades, poor performance, a shortened life span, and jamming of the cutting blades. Some autofeed shredders use large rotating drums using a vacuum to transport paper sheets from the paper tray to the cutting blades. What is needed is an elegant automatic paper shredder feeder having the ability to remove embedded staples or attached paper clips prior to shredding.

SUMMARY

Embodiments described herein provide a paper shredder with counter-rotating shredder blades coupled to a shredder motor, including a paper tray having a floor, the paper tray being shaped to receive paper; the floor having an offset slot therein adjacent to the counter-rotating shredder blades; and engagement wheels partly protruding through floor, adjacent to the offset slot, the engagement wheels configured to frictionally engage paper and to turn towards the offset slot. In some embodiments, the shredder includes a paper-in-tray sensor disposed in the floor, configured so that when paper is disposed adjacent to the paper-in-tray sensor, the shredder motor is configured to turn the engagement wheels and the counter-rotating shredder blades in the forward direction. These embodiments also can include a paper-at-entry sensor disposed perpendicularly to a longitudinal axis of the offset slot, the paper-at-entry sensor being a photodetector configured so that when paper is adjacent to the photodetector, the shredder motor turns the engagement wheels and the counter-rotating shredder blades in the forward direction thereby moving the paper through the offset slot and into the counter-rotating shredder blades.

In other embodiments, the paper shredder can include a dentate catch disposed in a corner of the paper tray, the dentate catch configured to temporarily hold an affixment while a sheet of paper in the paper tray held by the affixment is being frictionally engaged by the engagement wheels to enter the offset slot for comminution by the counter-rotating shredder blades. In selected ones of these embodiments, two pairs of dentate catches are disposed in each of the corners of the paper tray, the dentate catches having teeth oriented away from the offset slot. In yet other embodiments, the paper shredder includes a cover formed to cover the paper tray. Selected ones of these embodiments may include a cover open/closed sensor positioned to detect when the cover is closed on the paper tray. In still other embodiments, the floor of the paper tray is sloped at a vertical angle. In still other embodiments, the paper shredder includes a dentate catch disposed in a paper tray corner, the dentate catch having dentate catch teeth in a plane with and pointing away from the offset slot, and the dentate catch teeth configured to temporarily hold an affixment while a sheet of paper, held by the affixment, is frictionally engaged by the engagement wheels to enter the offset slot, to be stripped away from the affixment, and to be comminuted by the counter-rotating shredder blades.

In another embodiment of a paper shredder having a shredder motor and counter-rotating shredder blades coupled to the shredder motor, the paper shredder includes a paper tray having a floor, the paper tray being shaped to receive paper, the floor being vertically sloped; the floor having an offset slot adjacent to the counter-rotating shredder blades; engagement wheels partly protruding into floor, adjacent to the offset slot, the engagement wheels configured to frictionally engage paper into the offset slot; a paper-in-tray sensor disposed in the floor, configured so that when the paper is adjacent to the paper-in-tray sensor, the shredder motor activates the engagement wheels to turn in the direction of the offset slot; and a plurality of dentate catches disposed in corners of the paper tray, each of the plurality of dentate catches having teeth pointing away from the offset slot, and the dentate catch teeth configured to temporarily hold an affixment while an associated sheet of paper is being engaged by the engagement wheels for shredding. In certain ones of these embodiments, the shredder includes a paper-at-entry sensor disposed adjacent to the offset slot, the paper-at-entry sensor configured so that when paper is detected by the paper-at-entry sensor, the engagement wheels are activated to turn in the direction of the offset slot, frictionally engaging the paper; and a cover configured to cover the paper tray and including a cover slot in alignment with the offset slot, wherein the paper-at-entry sensor is configured to detect paper entered into the cover slot. In other embodiments, the shredder includes a cover formed to cover the paper tray; and a cover open/closed sensor positioned to detect when the cover is closed on the paper tray, allowing the paper shredder to operate. In yet other embodiments, the shredder includes a wastebin beneath the paper tray; and a PAPER FULL sensor coupled to the wastebin and configured to prevent the shredder motor from operating when the wastebin is full. Certain of these embodiments include a wastebin door coupled to the wastebin; and a DOOR OPEN sensor coupled to the wastebin door and configured to allow the shredder motor to operate when the wastebin door is closed. In still other embodiments, the shredder includes an OVERLOAD sensor coupled to the motor, the OVERLOAD sensor configured to cause the shredder motor to operate in a reverse direction for a predetermined time. Still other embodiments of the shredder has an OVERHEAT sensor coupled to the motor, the OVERHEAT sensor configured to turn off the shredder motor when the OVERHEAT sensor detects an overheating condition in the shredder motor.

In yet other embodiments of a shredder motor coupled to counter-rotating blades, the paper shredder has a paper tray having a floor, the paper tray being shaped to receive paper, the floor being obtusely vertically sloped; the floor having an offset slot adjacent to the counter-rotating shredder blades; engagement wheels partly protruding into floor, adjacent to the offset slot, the engagement wheels configured to frictionally engage paper into the offset slot; a paper-in-tray sensor disposed in the floor, configured so that when the paper is adjacent to the paper-in-tray sensor, the engagement wheels are activated to turn in the direction of the offset slot; a plurality of dentate catches disposed in corners of the paper tray, each of the plurality of dentate catches having dentate catch teeth pointing away from the offset slot, the dentate catch teeth configured to temporarily hold an affixment while an associated sheet of paper is being engaged by the engagement wheels and removed from the affixment for shredding; a paper-at-entry sensor disposed adjacent to the offset slot, the paper-at-entry sensor configured so that when paper is detected by the paper-at-entry sensor, the engagement wheels are activated to turn in the direction of the offset slot, frictionally engaging the paper and forcing it into the offset slot; a cover configured to cover the paper tray and including a cover slot in alignment with the offset slot, wherein the paper-at-entry sensor is configured to detect paper entered into the cover slot; a cover open/closed sensor positioned to detect when the cover is closed on the paper tray, allowing the paper shredder to operate; a wastebin beneath the paper tray; a PAPER FULL sensor coupled to the wastebin and configured to prevent the paper shredder from operating when the wastebin is full; a wastebin door coupled to the wastebin; a DOOR OPEN sensor coupled to the wastebin door and configured to allow the paper shredder to operate when the wastebin door is closed; an OVERLOAD sensor coupled to the motor, the OVERLOAD sensor configured to cause the motor to operate in a reverse direction for a predetermined time; and an OVERHEAT sensor coupled to the motor, the OVERHEAT sensor configured to turn off the motor when the OVERHEAT sensor detects an overheating condition in the motor.

BRIEF DESCRIPTION OF THE DRAWINGS

Embodiments of the present invention disclosed herein are illustrated by way of example, and are not limited by the accompanying figures, in which like references indicate similar elements, and in which.

Figure 1:
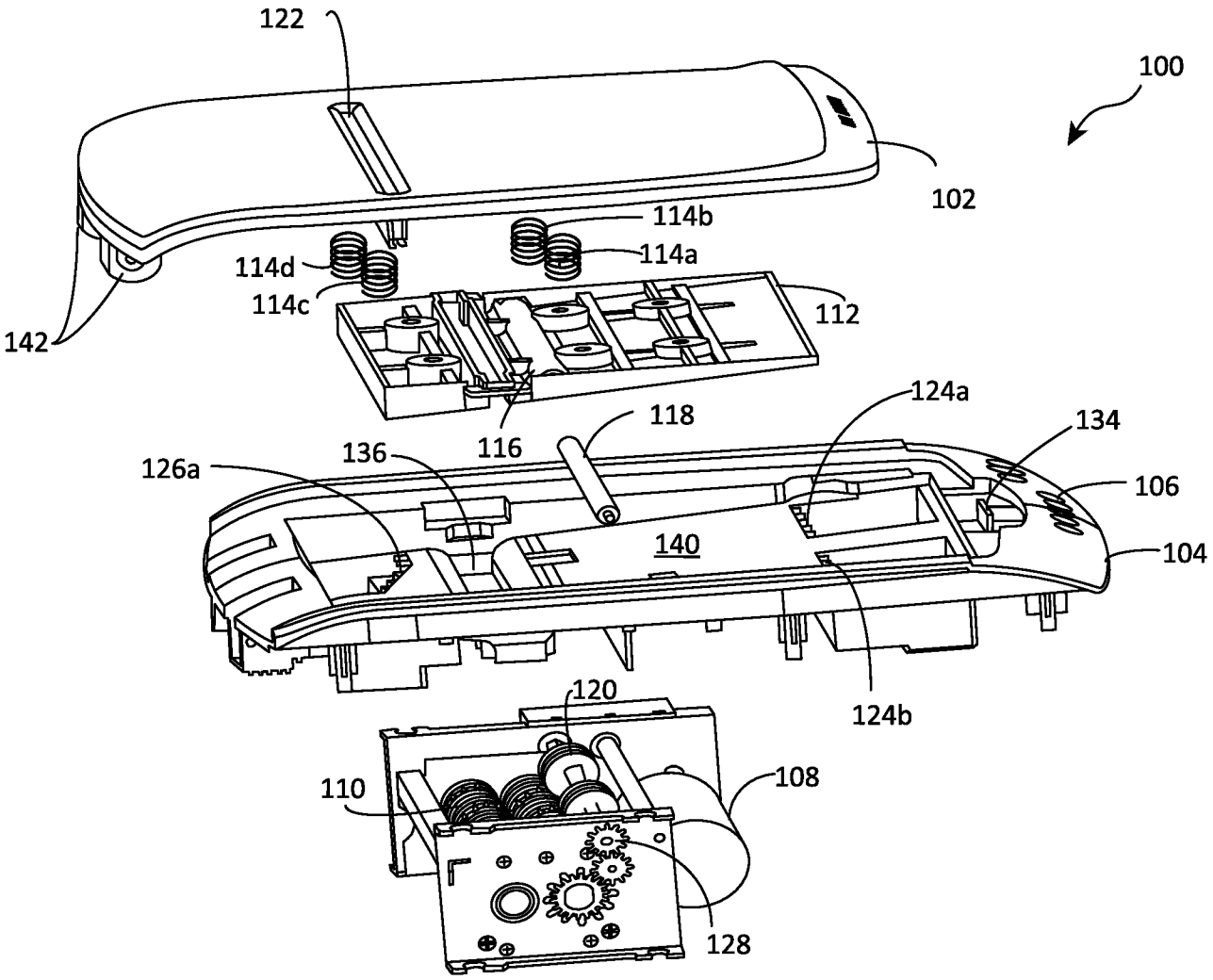
FIG. 1 is an exploded side view illustration of a shredder, in accordance with the teachings of the present invention.
Figure 2:
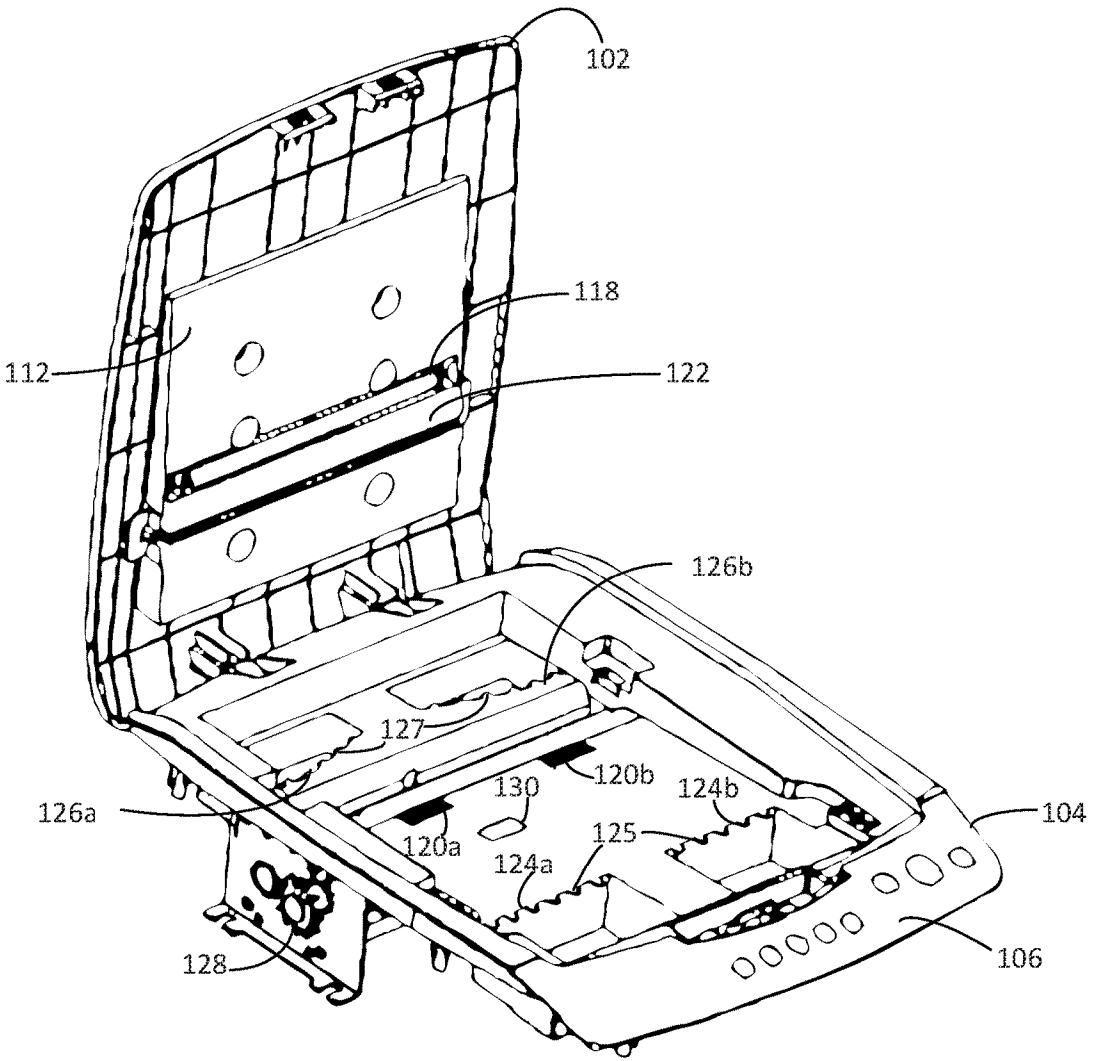
FIG. 2 is a perspective view of the shredder of FIG. 1, in accordance with the teachings of the present invention.
Figure 3:
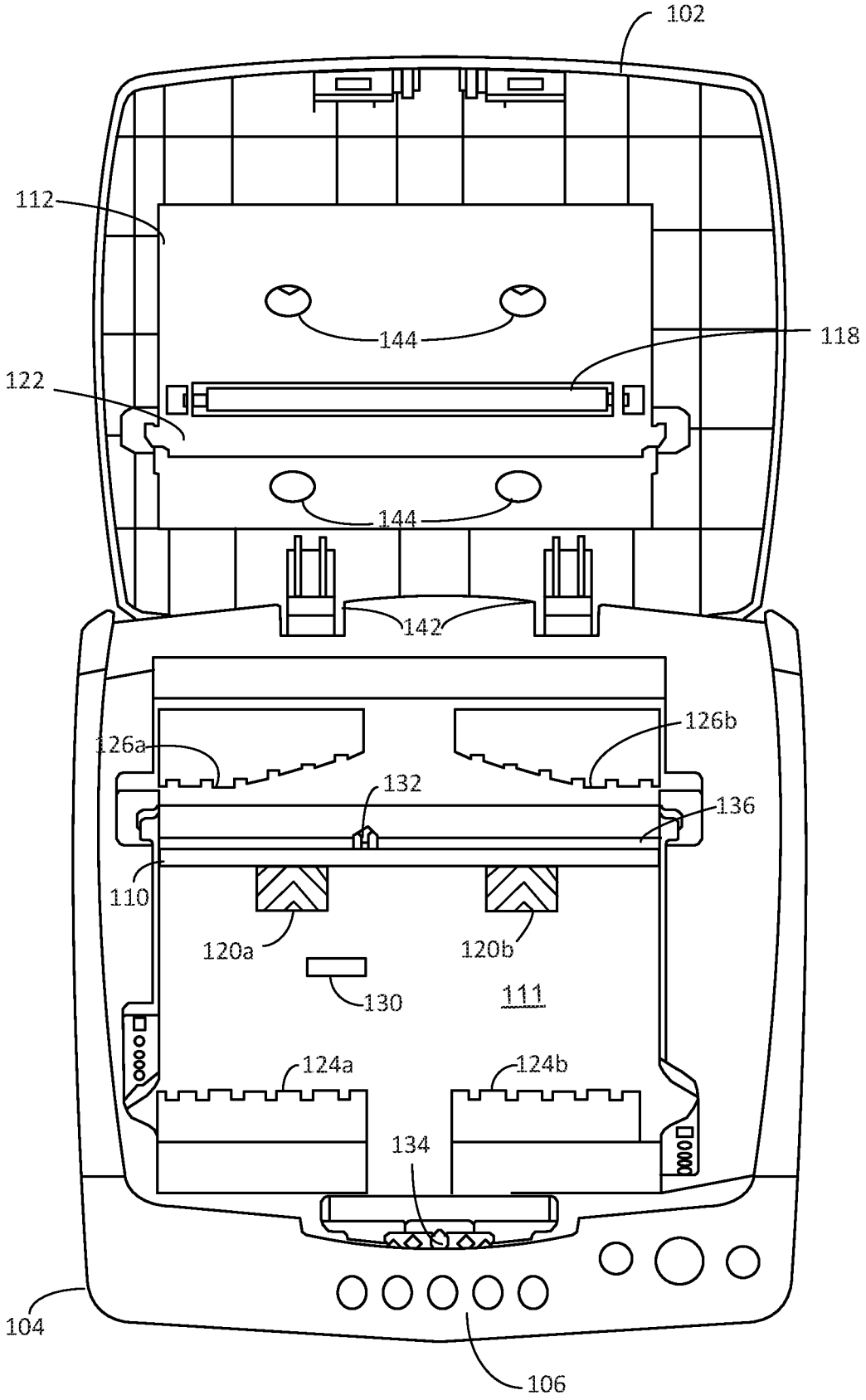
FIG. 3 is a top view of the shredder of FIG. 1, in accordance with the teachings of the present invention.
Figure 4:
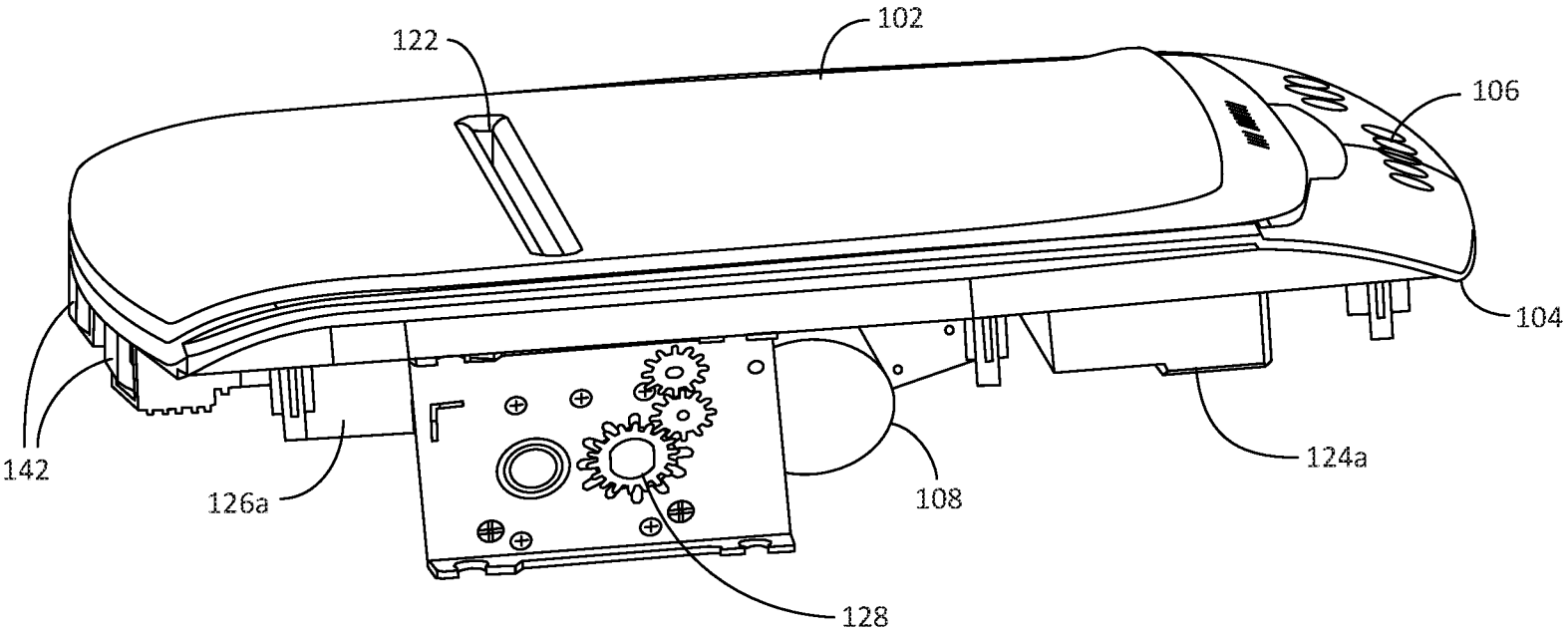
FIG. 4 is a side perspective view of the shredder of FIG. 1, in accordance with the teachings of the present invention.

The embodiments of the invention, and the various features and advantageous details thereof, are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated.

DESCRIPTION OF THE EMBODIMENTS

Embodiments herein provide an autofeed paper shredder, with integral affixment (e.g., clip and staple) removal. As illustrated in the exploded view in FIG. 1 and in FIGS. 2-10, autofeed paper shredder 100 includes shredder cover 102, shredder head 104, shredder control panel 106, shredder motor 108 coupled to shredder blades 110. Shredder 100 also includes pressing platen 112, resiliently attached to cover 102. In embodiments, resilient attachment can be provided by four springs 114*a-d* disposed generally between cover 102 and platen spring recesses 144. Platen roller housing 116 is configured to receive pressing platen roller 118, and to allow pressing platen roller 118 to freely rotate around its longitudinal axis. Pressing platen roller 118 is disposed to approximate with engagement roller (generally at 120). Engagement roller 120 can be rotatingly coupled to shredder motor 108 by way of shredder gears 128. Engagement roller 120 and main feed slot 136 can be asymmetrically disposed in paper tray 140, offset from the horizontal middle of longitudinal axis of paper tray 140. When engaged by shredder gears 128, engagement roller 120 can be rotated around its longitudinal axis. In embodiments, engagement roller 120 can be outfitted with two rotating engagement wheels 120*a*, 120*b*, which are disposed in opposing rotational approximation with pressing platen roller 118. Manual shredding slot 122 can be in direct communication with main feed slot 136, can be positioned above shredder blades 110, and can be used to manually feed shredder 100 instead of using the autofeed feature.

Shredder 100 also can include first catch 124*a-b* and second catch 126*a-b*. Embodiments of first catch 124*a-b* and second catch 126*a-b* can have integral dentate ridges (or teeth) 125, 127, which are positioned to catch and hold affixments (paper clips, staples, etc.) clasping one or more sheets disposed in paper tray 140. In embodiments, first dentate catch 124*a-b*, includes two catch rakes 124*a* and 124*b*, which can be disposed apart in respective front corners of paper tray 140 (adjacent to control panel 106) of shredder head 104. Catch rakes 124*a*, 124*b* are provided with a generally straight row of teeth across each of rakes 124*a*, 124*b*. On the other hand, second catch rakes 126*a* and 126*b* can be disposed apart at respective rear corners of paper tray 140 (adjacent to hinge 142). Catch rakes 126*a*, 126*b* are provided with a generally slanted or arcuate row of teeth disposed across each of rakes 126*a*, 126*b* which, in some embodiments, can be slanted backwards towards the center rear of paper tray 140. In some embodiments, the floor 111 of paper tray 140 may be sloped with a vertical angle (obtuse angle); in others, the floor 111 of paper tray 140 may be flat, with essentially no vertical angle.

Disposed in paper tray 140 floor 111 can be paper-in-tray (PIT) sensor 130, which can be, for example, a capacitive sensor or a photodiode sensor. PIT sensor 130 can be actuated when paper is placed in paper tray 140. When one or more sheets of paper are placed in paper tray 140, the paper causes a change in the capacitance of the sensor (when a capacitive sensor is used), causing the PIT sensor 130 to automatically turn on the autofeed paper shredder 100 in the forward direction. Of course, PIT sensor 130 may be other types of sensors which can indicate the presence of material in paper tray 140. Paper tray 140 can be configured to receive a predetermined number of paper sheets having a predefined paper weight (e.g., 20 sheets of 20 lb. paper). It also may be configured to accept a range of paper sizes (e.g., ledger, legal, letter, executive, #10 envelope, etc.) in a fixed paper tray size.

One or more sheets of paper may be fastened with an affixment. Protruding from the floor 111 of paper tray 140 can be engagement roller wheels 120*a*, 120*b* of engagement roller 120. More or less wheels, in other configurations, may be used. Engagement roller wheels 120*a*, 120*b* can frictionally engage a sheet of paper, and can draw the sheet of paper into feed slot 136. Roller wheels 120*a*, 120*b*, urge the frictionally engaged piece of paper into the shredder blades 110 for comminution and can tear the sheet of paper from its affixment.

Alternatively to autofeed, up to a selected number of sheets of paper, of a predetermined paper thickness, can be manually fed into shredder 100 through manual shredding slot 122, which is in communication with feed slot 136. With Cover Open/Closed sensor 134 sensing cover 102 being closed, paper-at-entry (PAE) sensor 132 can be used to detect the presence of paper at the entry of main feed slot 136, thereby causing shredder 100 to automatically operate in the forward direction. In the manual feed mode, autofeed features can be de-activated. PAE sensor 132 can be a transmitter/sensor LED pair, a capacitive sensor, or some other paper detector sensor. In embodiments, PAE sensor 132 can be a LED transmitter/sensor pair. Whether in the manual feed mode or in the autofeed mode, paper-at-entry sensor 132 causes activation of shredder motor 108 when paper is at the mouth of main feed slot 136. Shredder motor can be deactivated when paper-at-entry sensor 132 does not sense paper.

Figure 5:
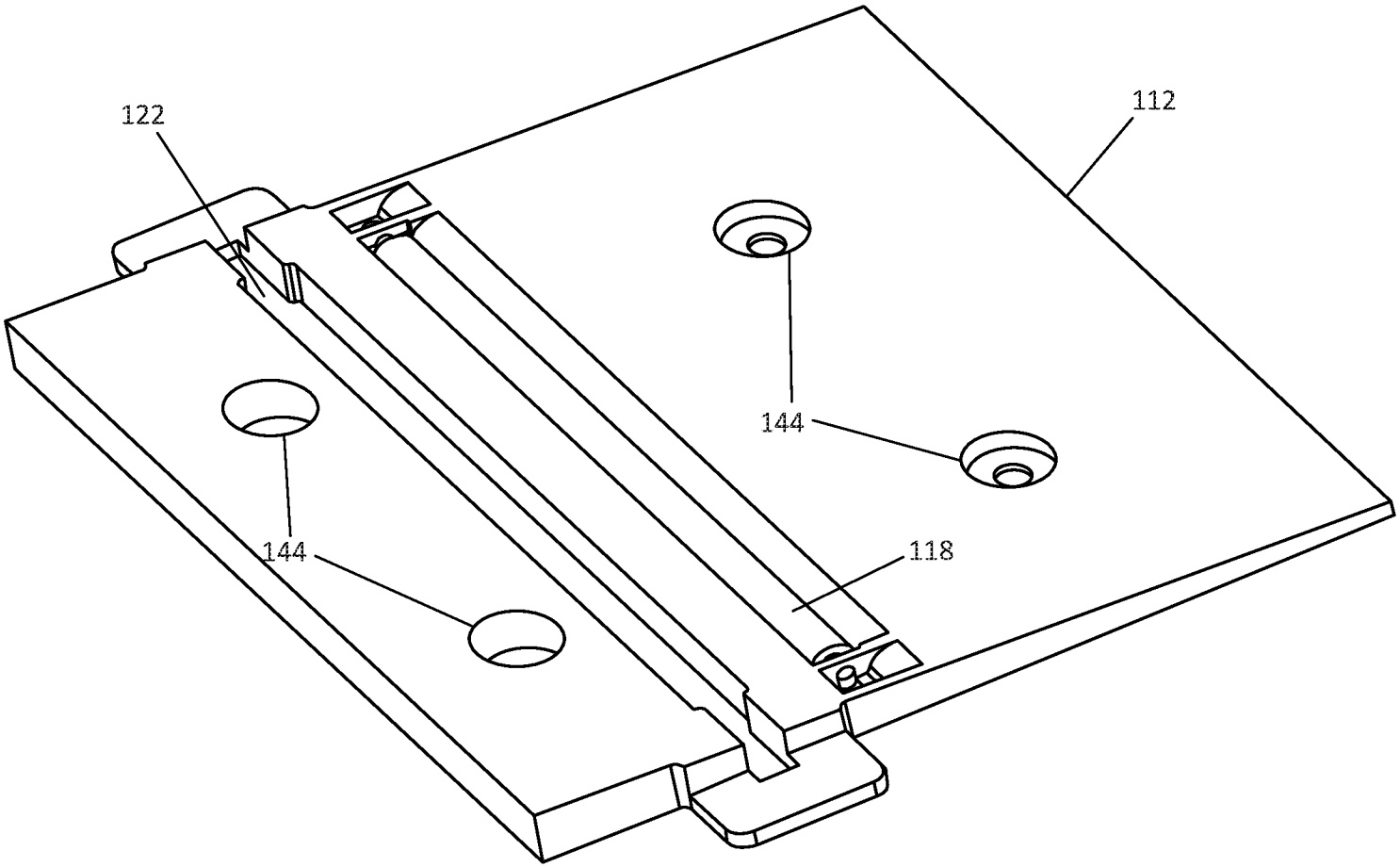
FIG. 5 is a perspective view of a pressing platen and pressing platen roller, in accordance with the teachings of the present invention.
Figure 6:
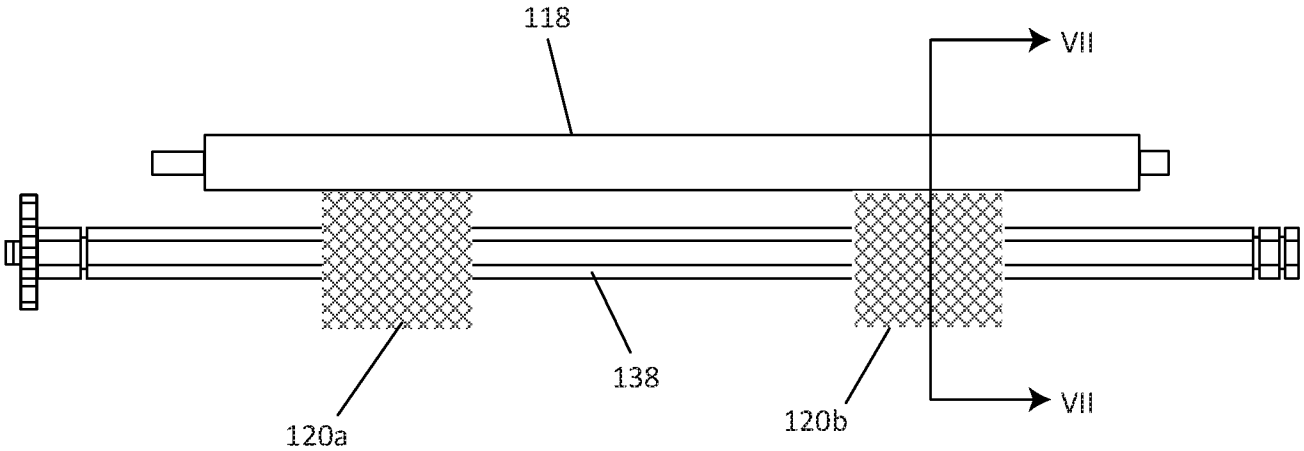
FIG. 6 is a head-on view of a pressing platen roller in contact with two engagement rollers, in accordance with the teachings of the present invention.
Figure 7:
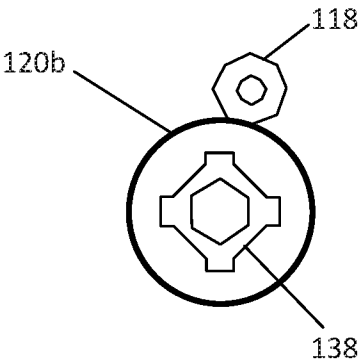
FIG. 7 is a cross-sectional view of FIG. 6, taken along the line VII-VII, in accordance with the teachings of the present invention.

FIG. 5 is an illustration of pressing platen 112, having pressing platen roller 118 and manual shredding slot 122. Pressing platen 112 may be spring-biased to cause pressing platen 112 and pressing platen roller 118 to gently press downwardly upon paper which may be disposed on engagement wheels 120*a*, 120*b*. FIG. 6 illustrates the proximal contact between pressing platen roller 118 and engagement roller wheels 120*a*, 120*b*, which contact can be experienced when no paper is left in tray 140. Wheels 120*a*, 120*b* can be secured to engagement roller shaft 138. When paper is placed in the tray 140, pressing platen 112 presses paper between roller 118 and wheels 120*a*, 120*b* and maintains the pressure until no paper remains. FIG. 7 is a cross-sectional view of FIG. 6 taken at section VII-VII, and showing cross-sections of engagement roller wheel 120*b*, pressing platen roller 118, and engagement roller shaft 138.

Figure 8:
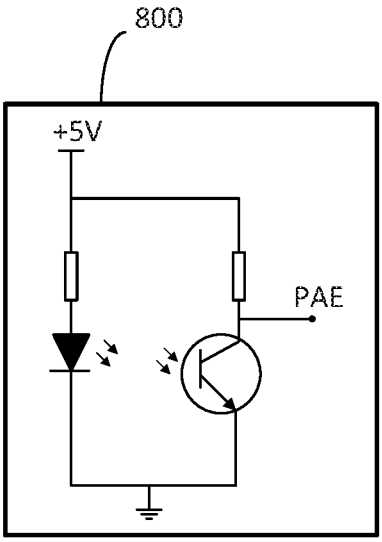
FIG. 8 is a schematic of an LED paper-at-entry sensor, or a cover open/closed sensor, in accordance with the teachings of the present invention.
Figure 9:
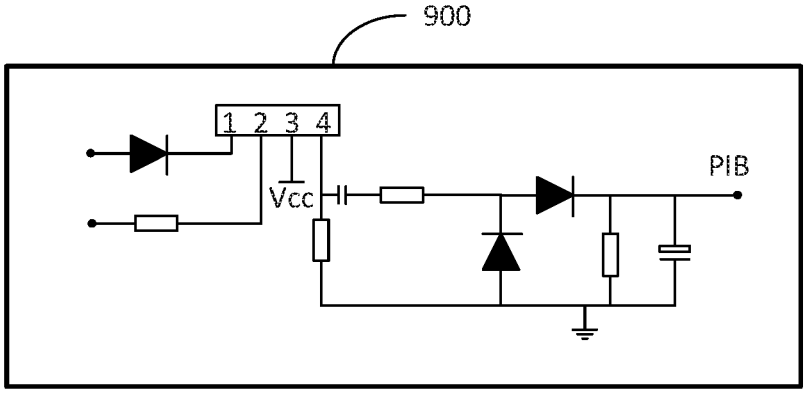
FIG. 9 is a schematic of a capacitive paper-in-tray sensor, in accordance with the teachings of the present invention.
Figure 10:
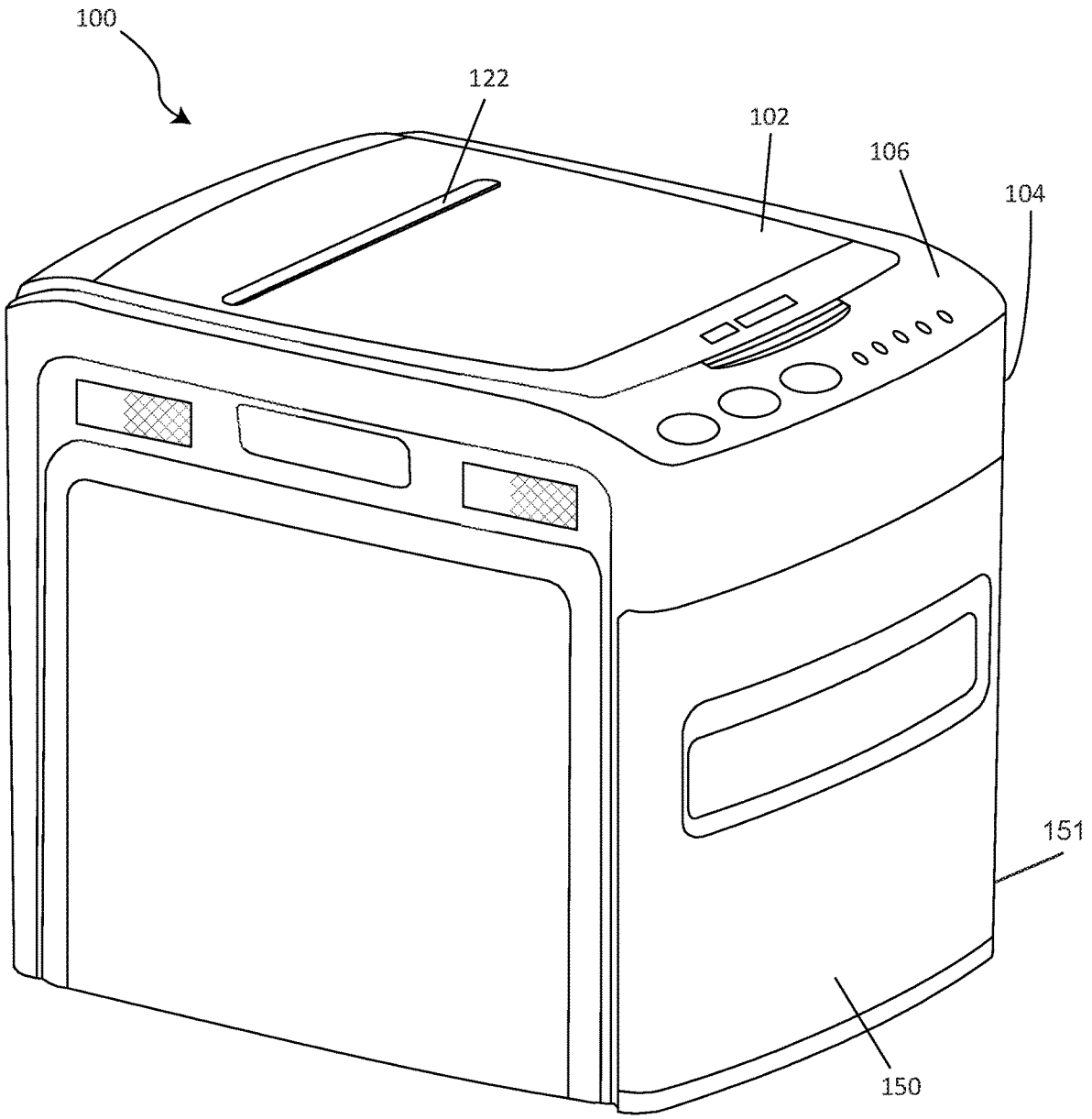
FIG. 10 is an illustration of a shredder with wastebin, in accordance with the teachings of the present invention.

FIG. 8 illustrates an example of a LED transmitter/sensor pair 800, as may be found in the paper-at-entry sensor 132. LED transmitter/sensor pair 800 also may be the type of sensor used for the cover open/closed sensor 134. FIG. 9 illustrates an example of a capacitive sensor 900, as may be used by paper-in-tray sensor 130. FIG. 10 is an embodiment of autofeed shredder 100 that is shown assembled, including wastebin 150 and wastebin door 151. Wastebin 150 can have a "paper full" detector therein, which interrupts shredder operation if wastebin 150 is full of shredded paper. Also illustrated in FIG. 10 is cover 102, shredder head 104, and display panel 106. Other embodiments of wastebin 150 are possible.

Figure 11A:
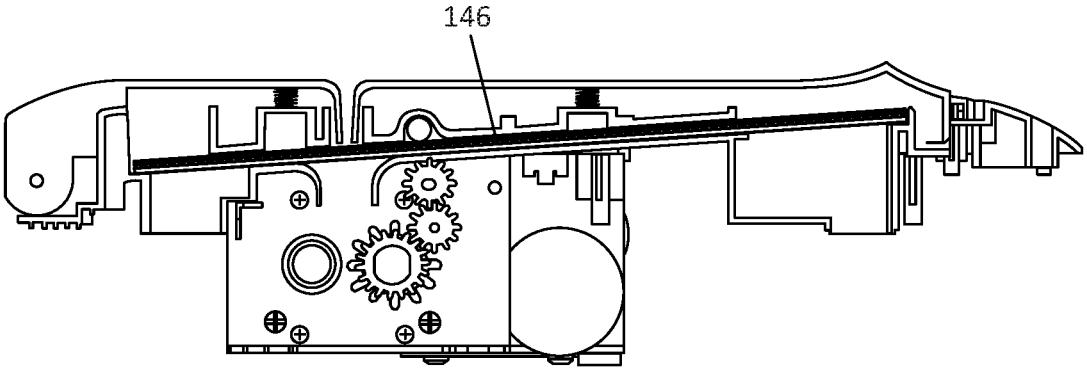
FIG. 11A is a sectional view illustration of the shredder of FIGS. 1-10, in which paper is in the paper tray, in accordance with the teachings of the present invention.
Figure 11B:
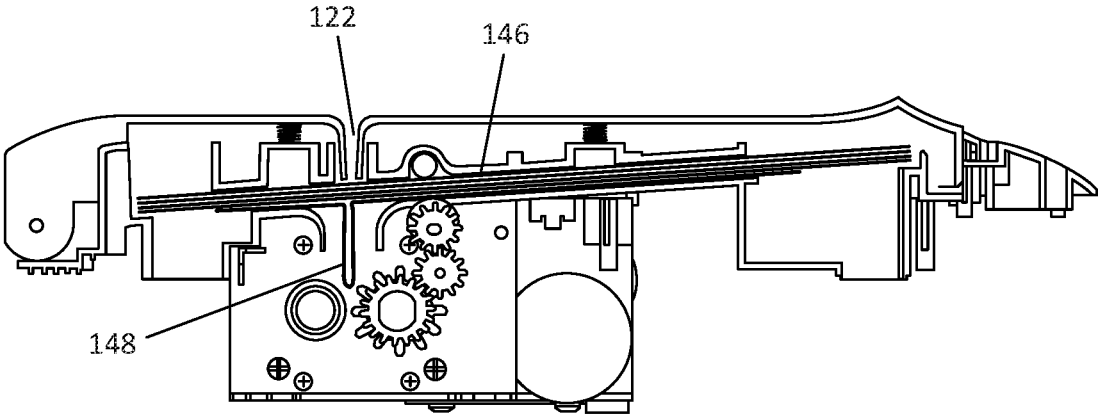
FIG. 11B is a representation of FIG. 11A, with engaged paper, in accordance with the teachings of the present invention.

FIGS. 11A and 11B illustrate autofeed shredder in operation in the context of FIGS. 1-10. In operation, when cover 102 is securely closed, as detected by Cover Open/Closed (COC) sensor 134, PIT sensor 130 is turned on to detect whether paper 146 is in tray 140. COC sensor 134 can be a LED transmitter/sensor pair (i.e., a photodetector) or some other type of door open/closed sensor. If paper 146 is detected in tray 140, then paper-in-tray sensor 130 causes shredder motor 108 to turn on and shredder blades to rotate in the forward direction (i.e., to feed into wastebin 150). Pressing platen roller 118 presses paper 146 in tray 140 against engagement roller wheels 120*a*, 120*b*. Wheels 120*a*, 120*b* press frictionally engaged paper 148 into main feed (offset) slot 136. Once provided into main feed (offset) slot 136, frictionally engaged paper 148 can be captured by shredder blades 110 and comminuted into shreddant (not shown). If an affixment, such as a paper clip or staple, binds together one or more sheets of paper 148, the affixment is captured by one or more of the teeth on at least one of the catch rakes 124*a*, 124*b*, 126*a*, 126*b*, and held in place until the last sheet of paper is stripped away. A portion of catch rakes 124*a*, 124*b*, 126*a*, and 126*b* can communicate with the shredder waste tray (not shown), and the captured paper clip or staple can fall harmlessly into the wastebin 150.

Autofeed shredder 100 can include an Overload mode, in which too much paper is inserted into main feed slot 136, causing shredder motor 108 to stall and an Overload signal to be sent to logic of shredder 100. In this case, logic is provided to turn off motor 108, and then to cause reverse operation of motor 108 for a preselected period, for example, 2.5 seconds. Other preselected periods may be chosen. This reverse operation can cause shredder blades 110 to rotate opposite of the forward mode, expelling the excessive paper from shredder blades 110. Shredder blades then can move forward briefly to clear the shredder blades. Also, a Motor Overheating mode can be provided in which motor 108 is turned off to prevent damage from overheating, often caused by shredder 100 overuse. In this instance, a Motor Overheating signal is emitted and motor 108 shuts down. In some embodiments, motor 108 shuts down for a predetermined cooldown period during which motor operation is prevented and after which motor operation is permitted.

Figure 24:
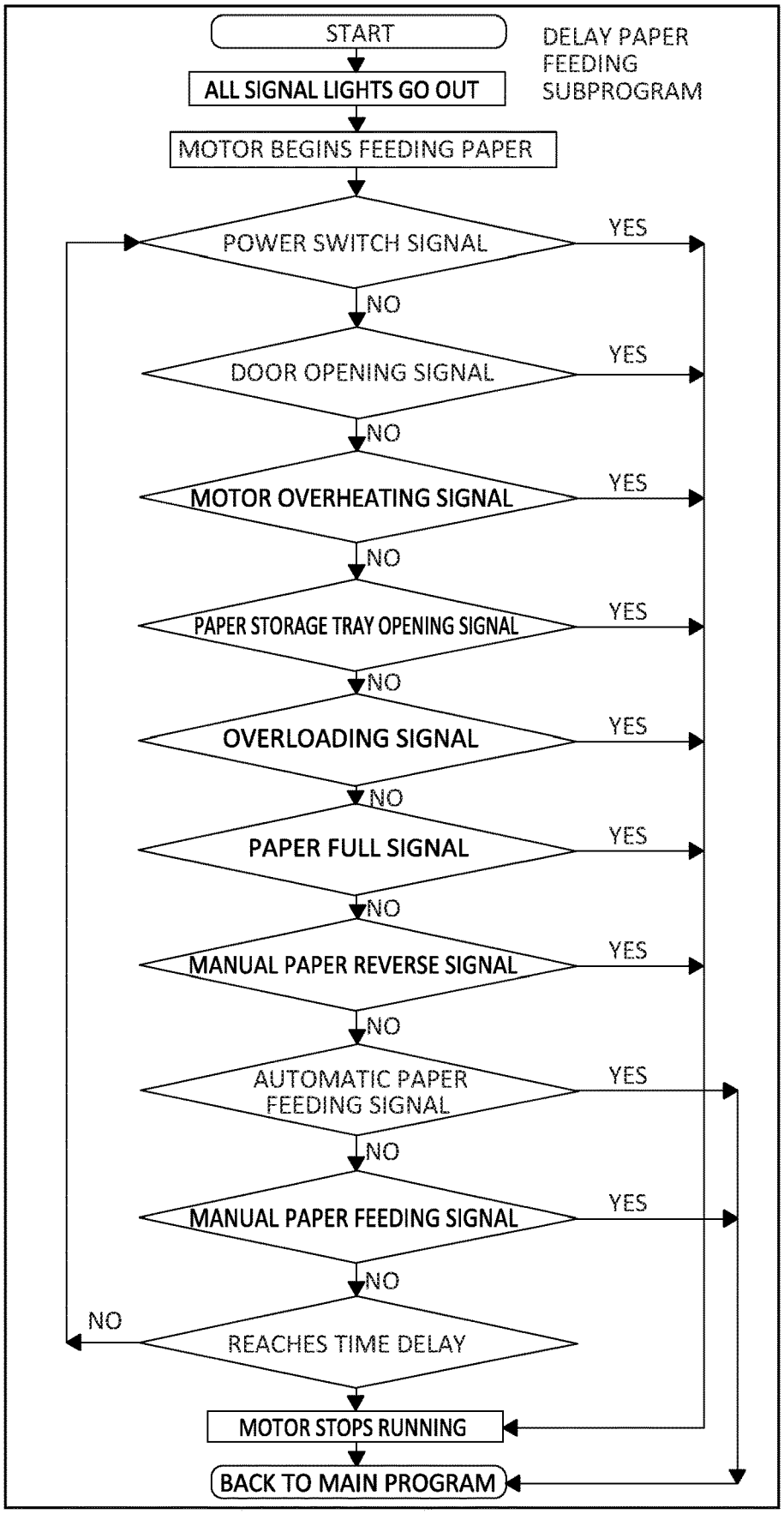
FIG. 24 is a flow chart for the logic of the shredder Delay Paper Feed subprogram, in accordance with the teachings of the present invention.
Figure 25:
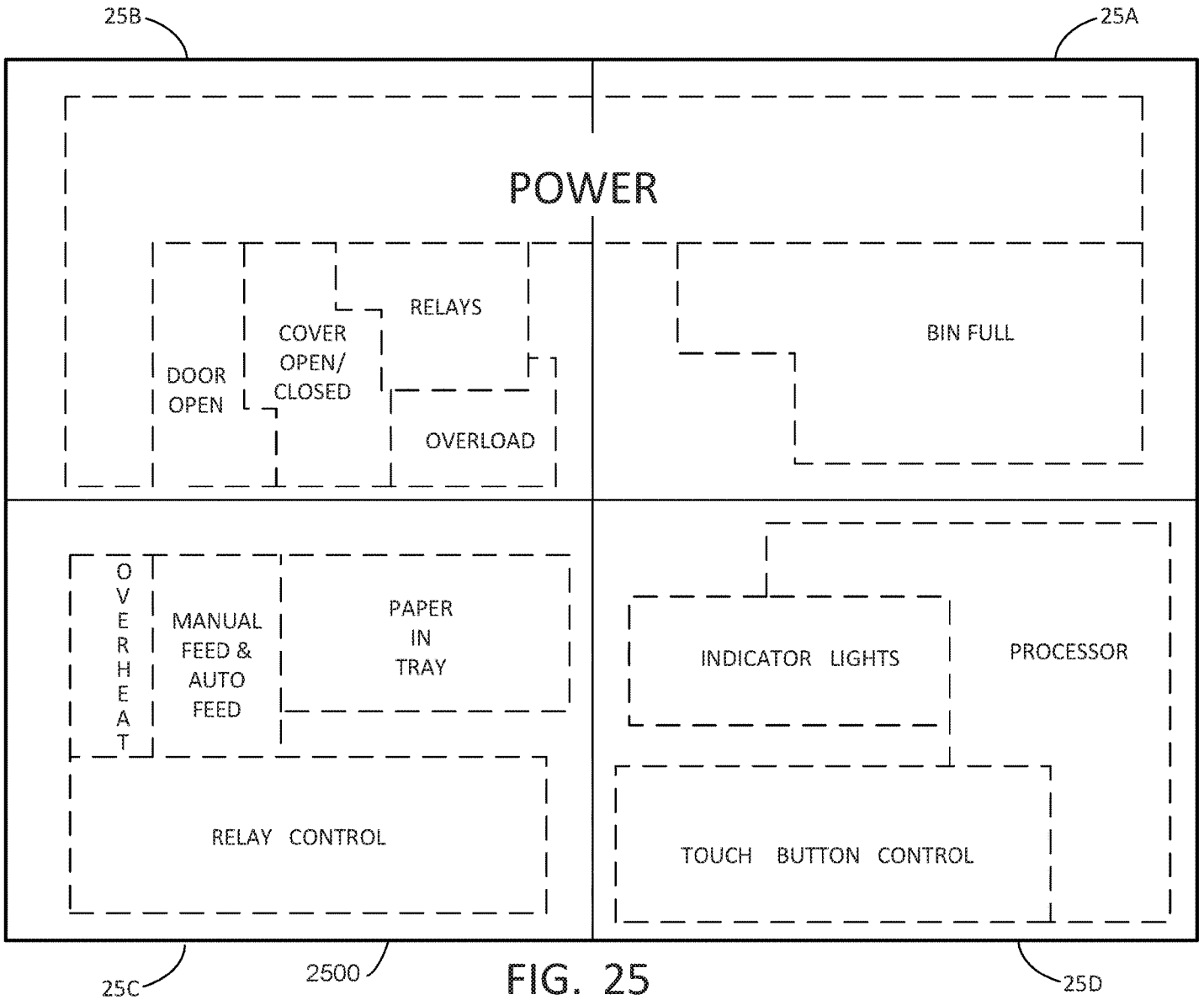
FIG. 25 is a floor plan illustration of a schematic embodiment for an autofeed paper shredder represented by FIG. 25A-D, in accordance with the teachings of the present invention.

FIGS. 12-24 illustrate respective embodiments of the methods of operating autofeed paper shredder 100. FIG. 25 illustrates a floor plan of an embodiment of schematic 2500 in FIGS. 25A-25D. FIGS. 25A-25D together illustrate an embodiment of schematic 2500 for autofeed paper shredder 100, which implements the logic of FIGS. 12-24.

Figure 12:
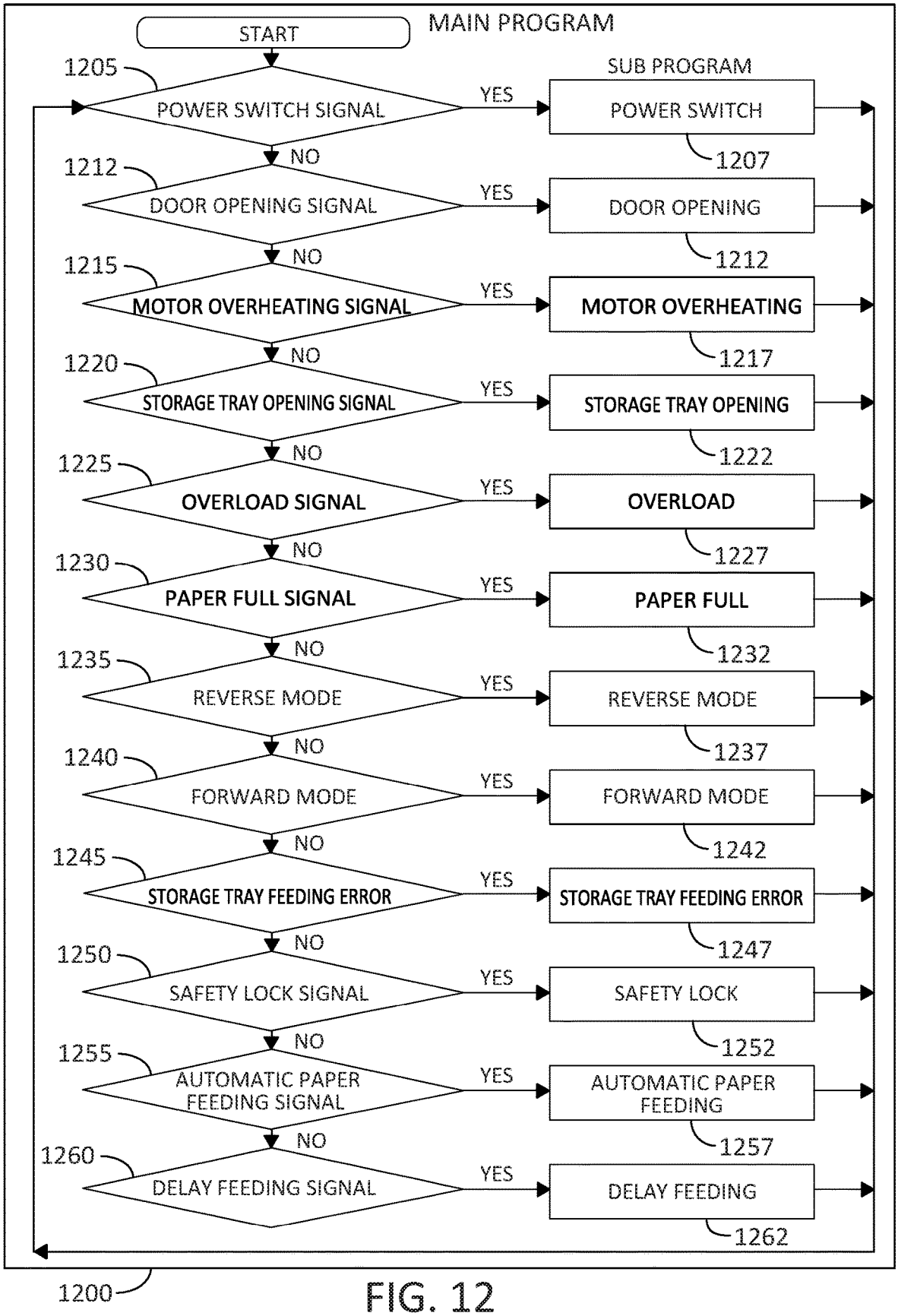
FIG. 12 is a flow chart for the logic of the shredder Main program, in accordance with the teachings of the present invention.
Figure 13:
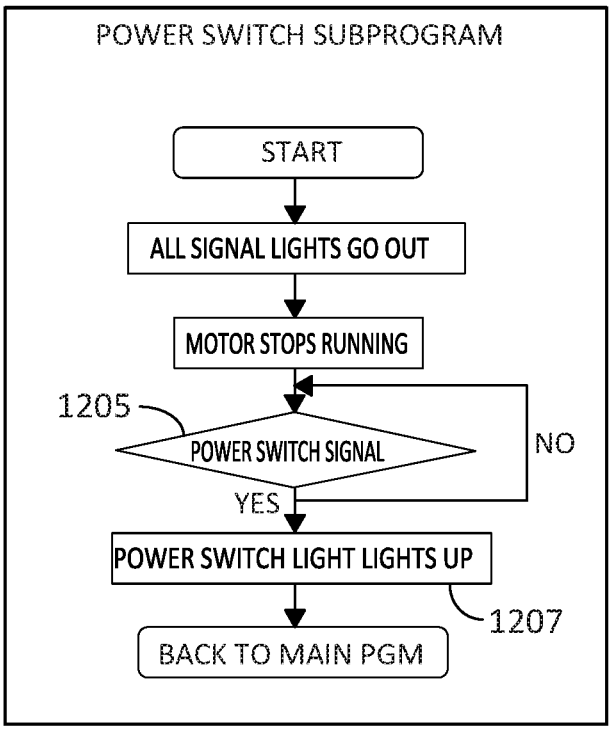
FIG. 13 is a flow chart for the logic of the Shredder Power Switch subprogram, in accordance with the teachings of the present invention.
Figure 14:
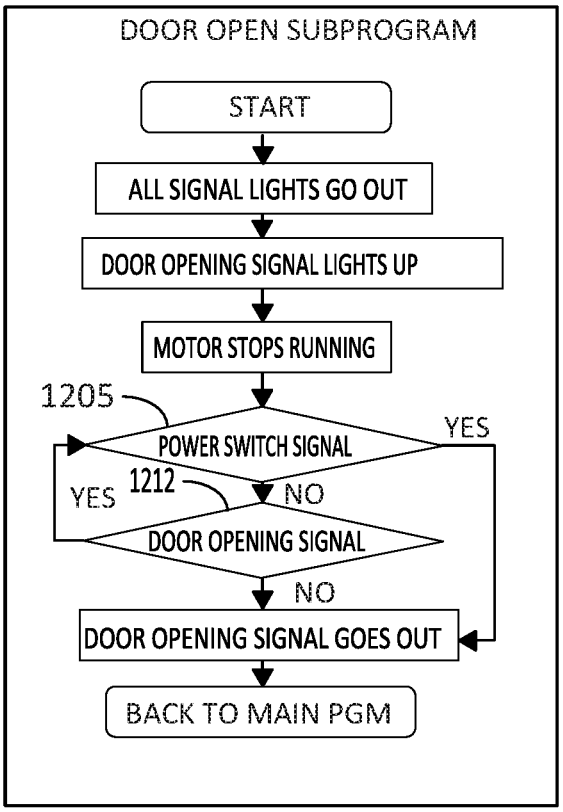
FIG. 14 is a flow chart for the logic of the Shredder Wastebin Door Open subprogram, in accordance with the teachings of the present invention.
Figure 15:
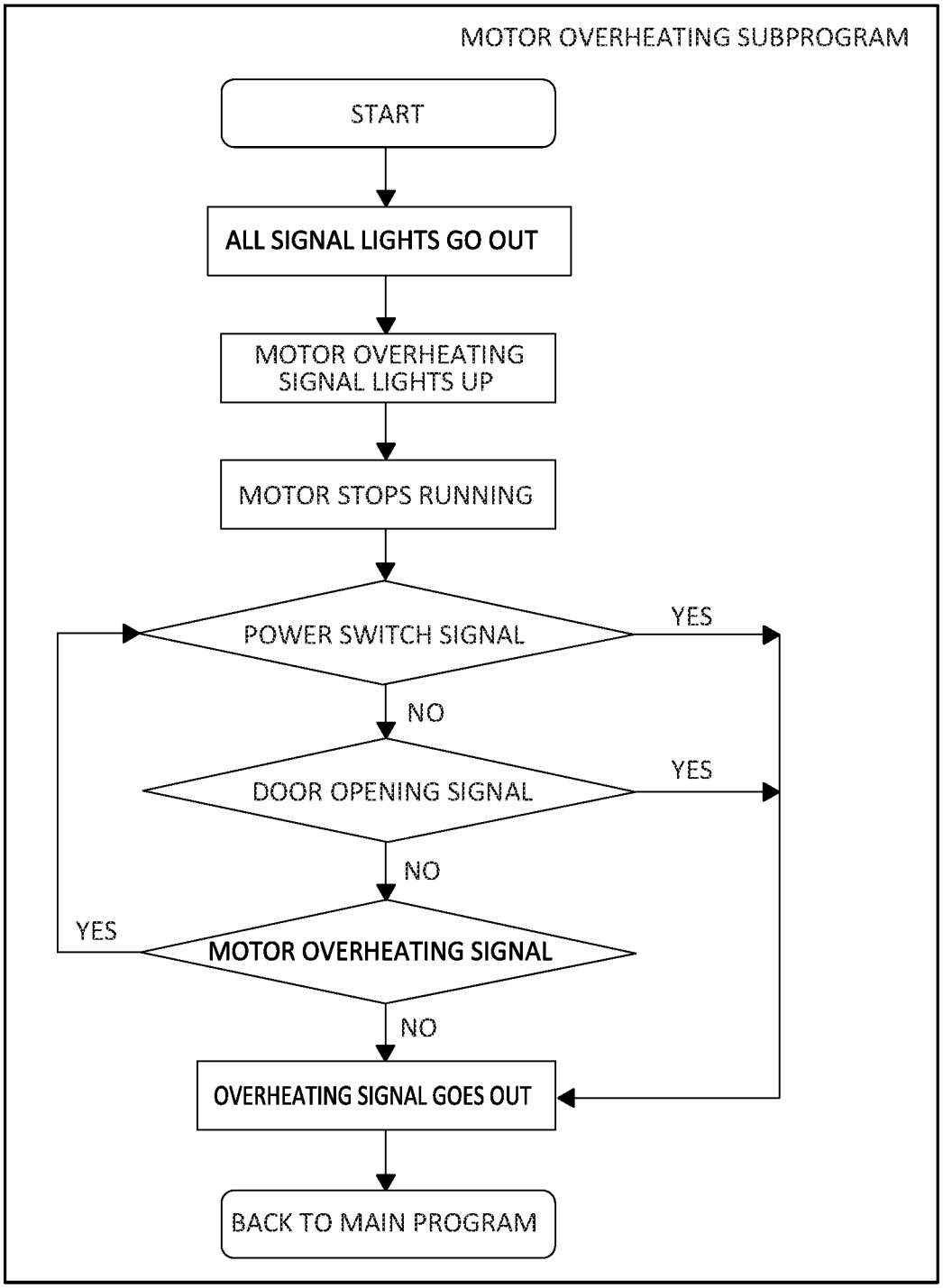
FIG. 15 is a flow chart for the logic of the Shredder Motor Overheating subprogram, in accordance with the teachings of the present invention.
Figure 16:
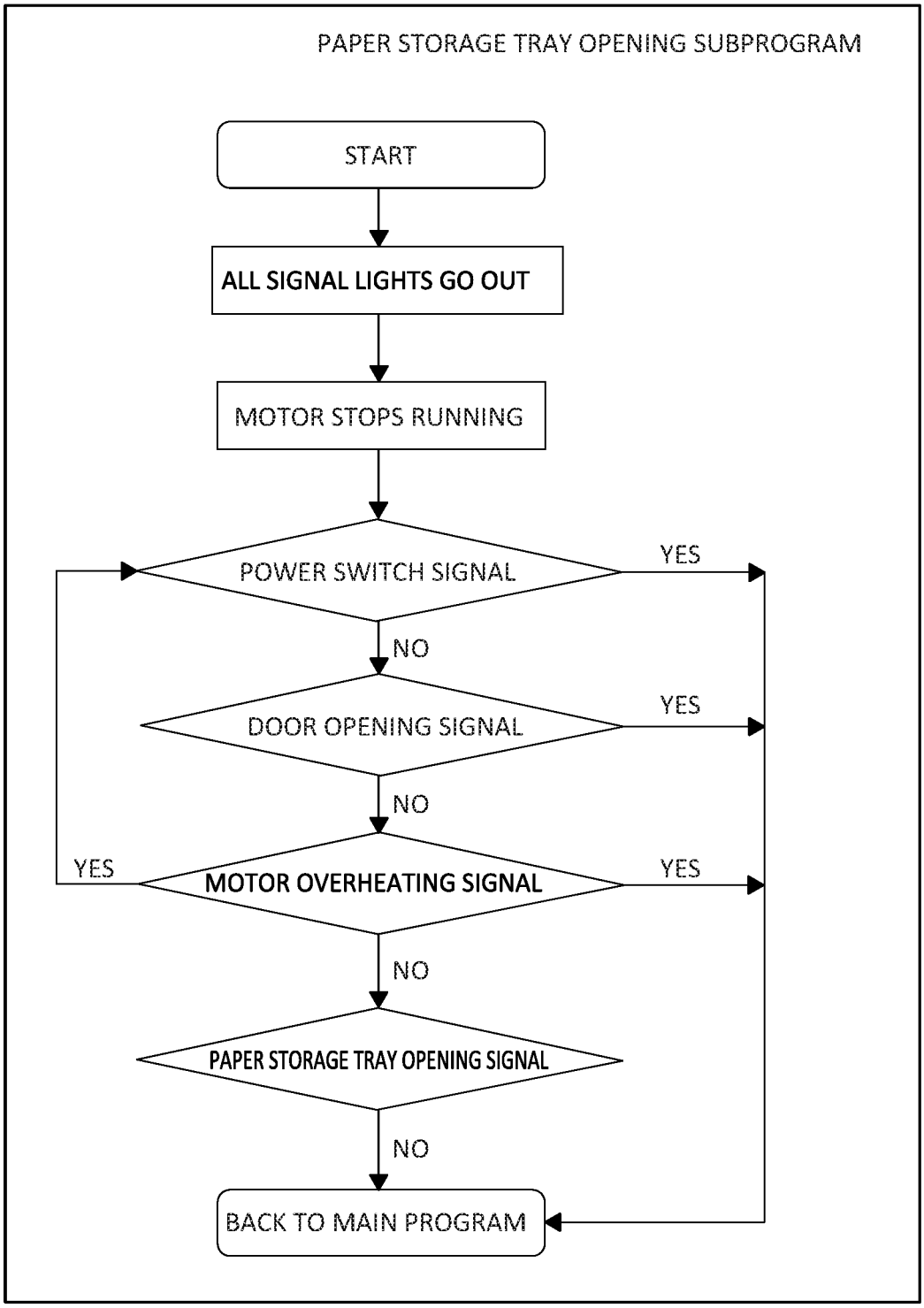
FIG. 16 is a flow chart for the logic of the Shredder Paper Storage Tray Open subprogram, in accordance with the teachings of the present invention.
Figure 17:
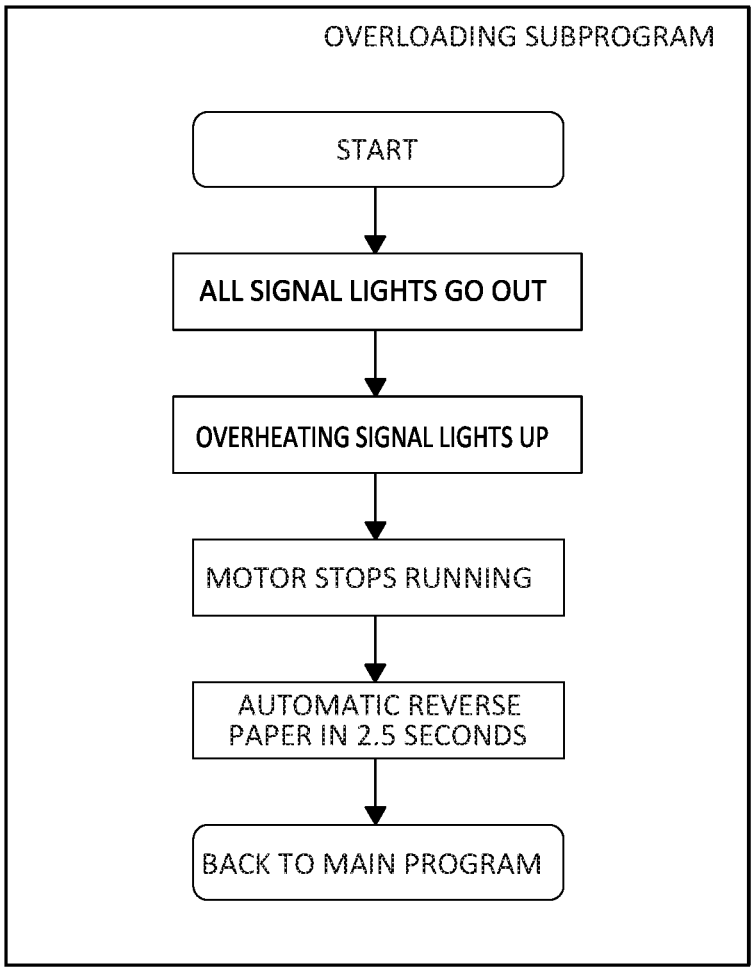
FIG. 17 is a flow chart for the logic of the shredder Overload subprogram, in accordance with the teachings of the present invention.
Figure 18:
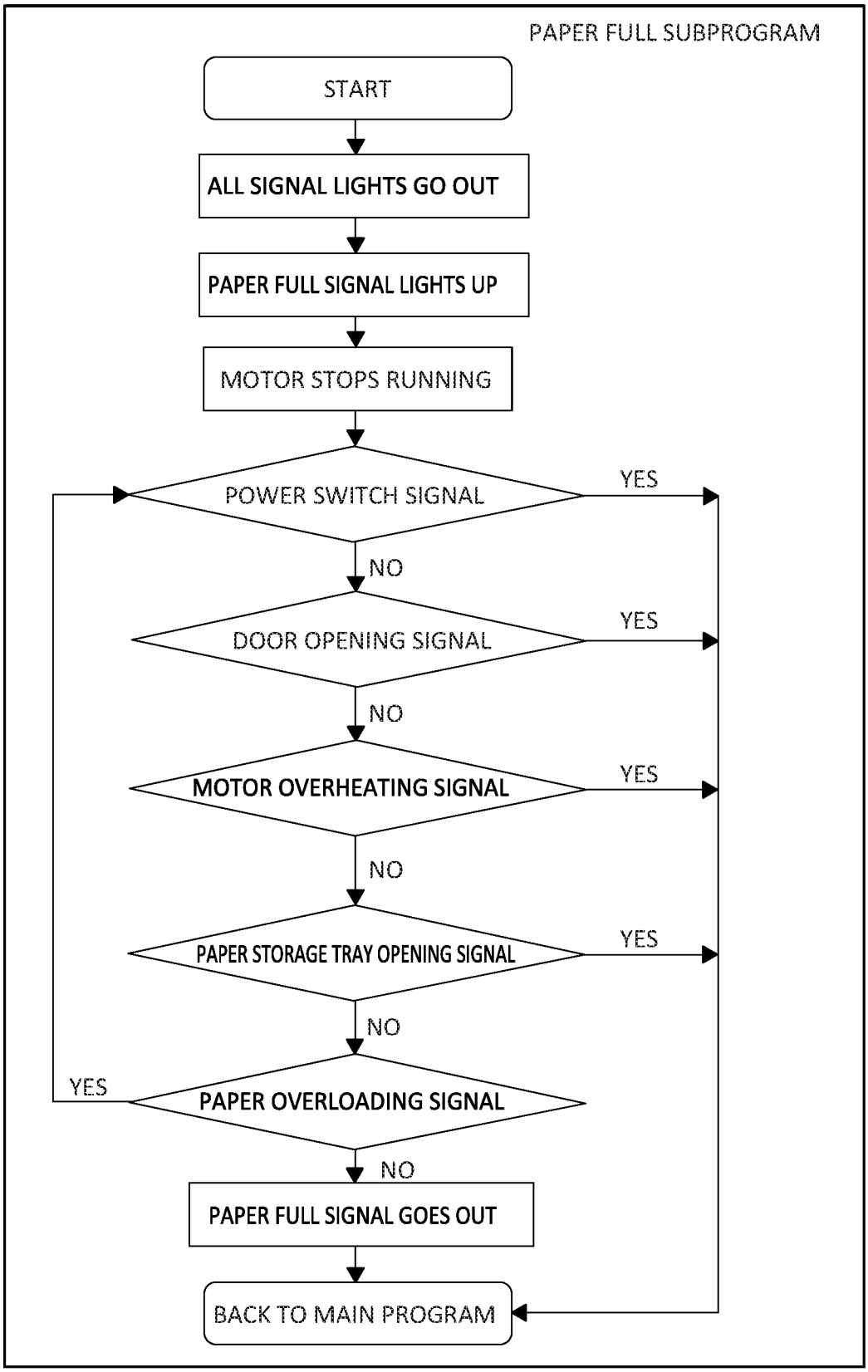
FIG. 18 is a flow chart for the logic of the shredder Paper Full subprogram, in accordance with the teachings of the present invention.
Figure 19:
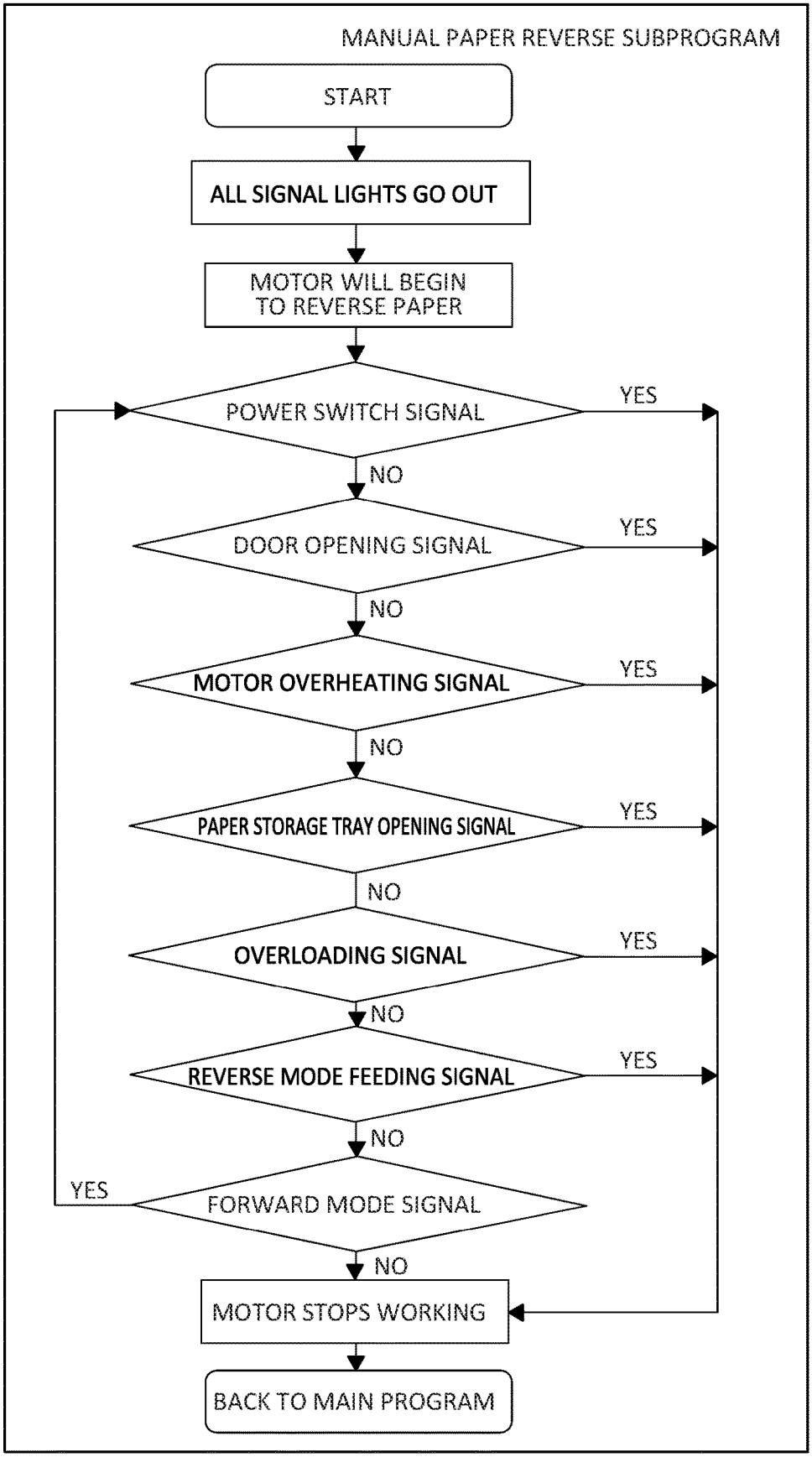
FIG. 19 is a flow chart for the logic of the shredder Manual Paper Reverse subprogram, in accordance with the teachings of the present invention.
Figure 20:
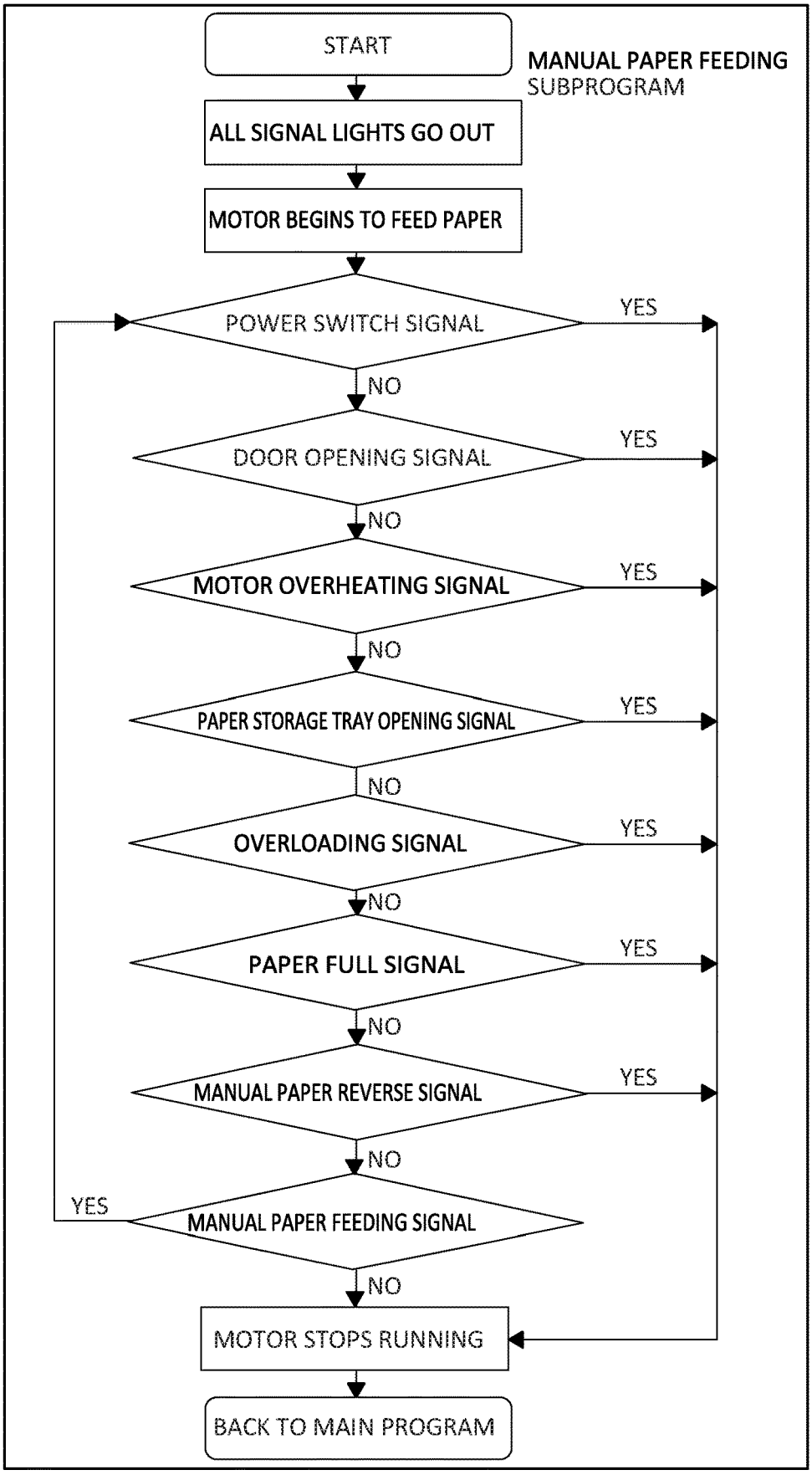
FIG. 20 is a flow chart for the logic of the shredder Manual Paper Feed subprogram, in accordance with the teachings of the present invention.
Figure 21:
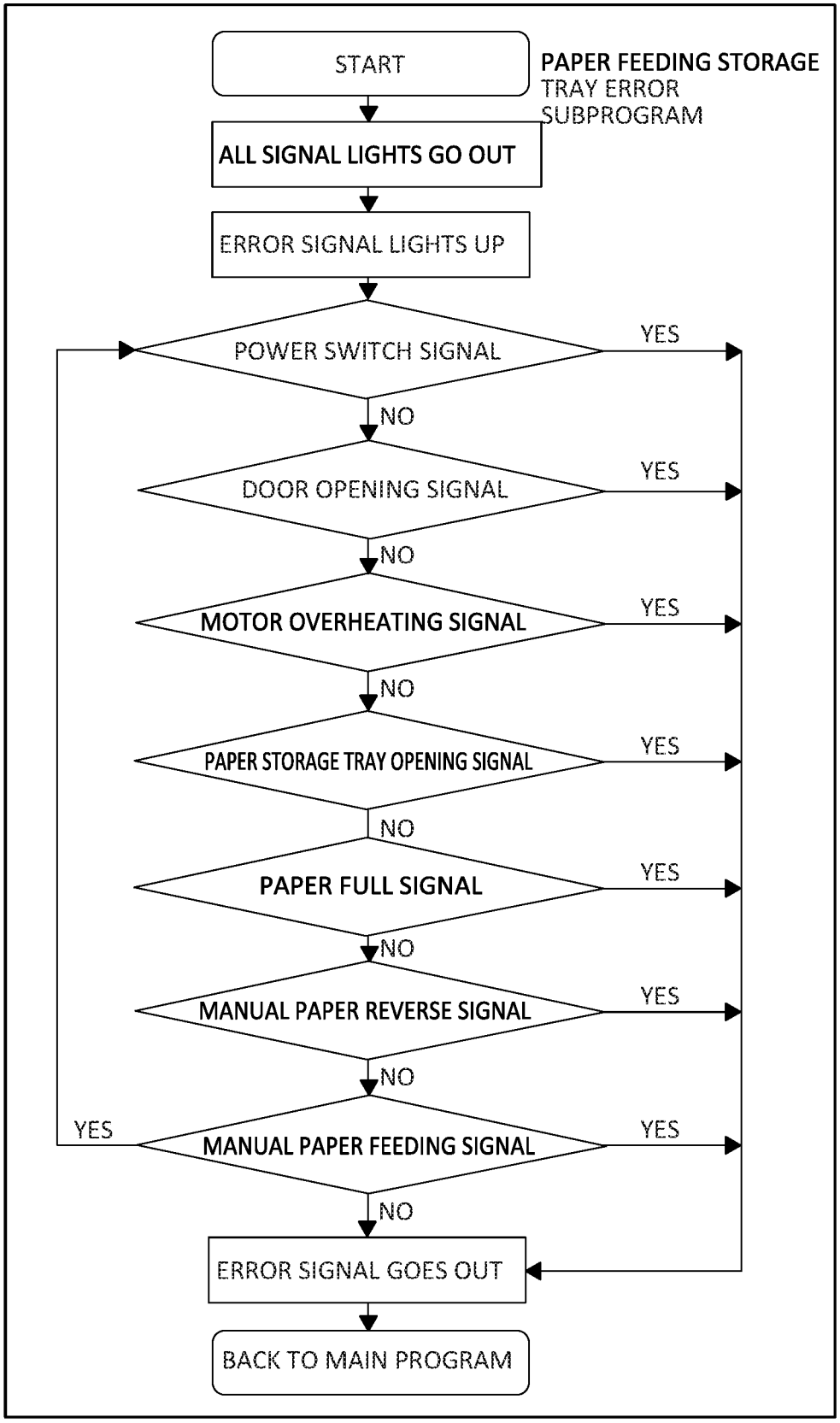
FIG. 21 is a flow chart for the logic of the shredder Paper Storage Tray Feeding Error subprogram, in accordance with the teachings of the present invention.
Figure 22:
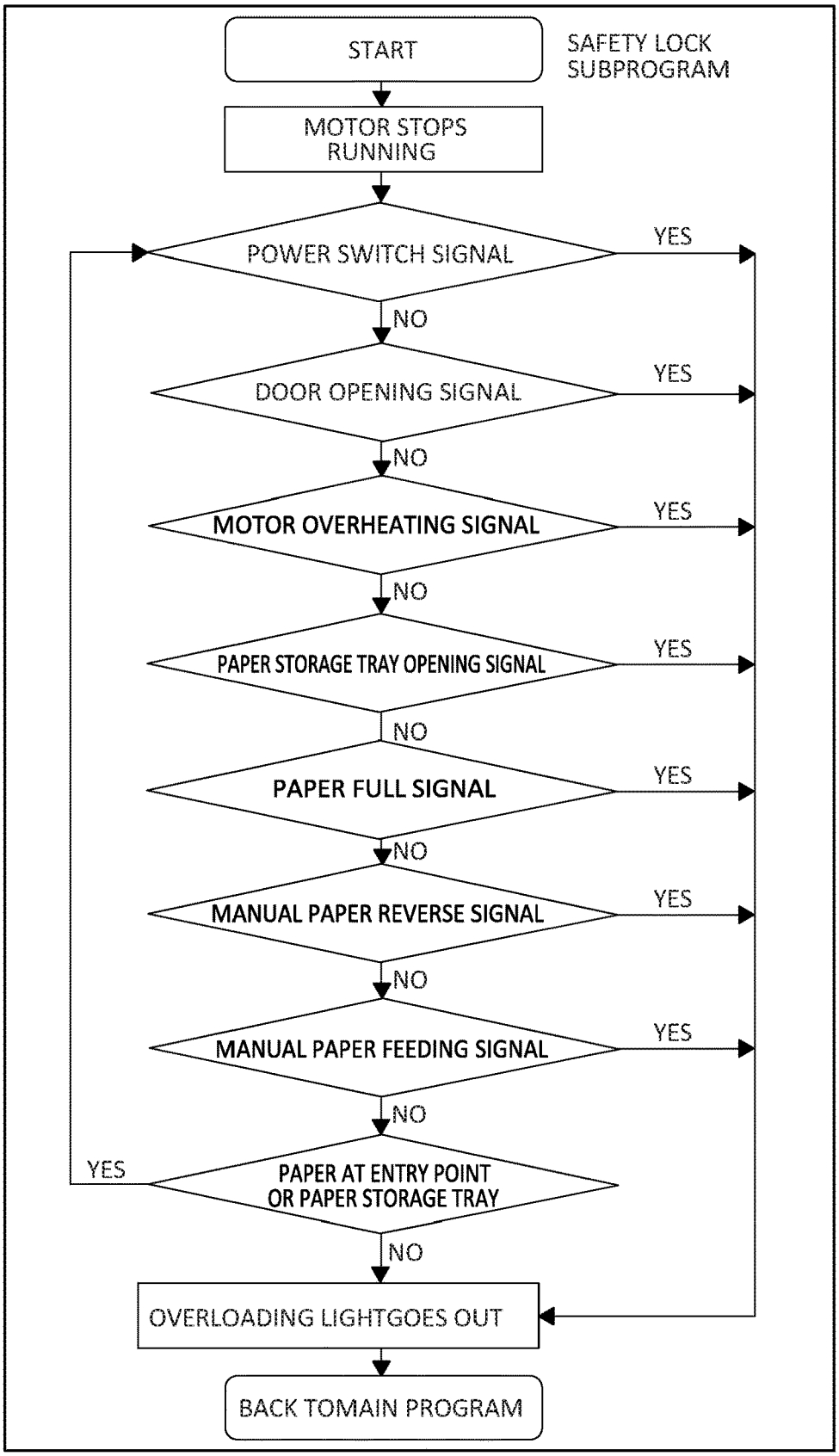
FIG. 22 is a flow chart for the logic of the shredder Safety Lock subprogram, in accordance with the teachings of the present invention.
Figure 23:
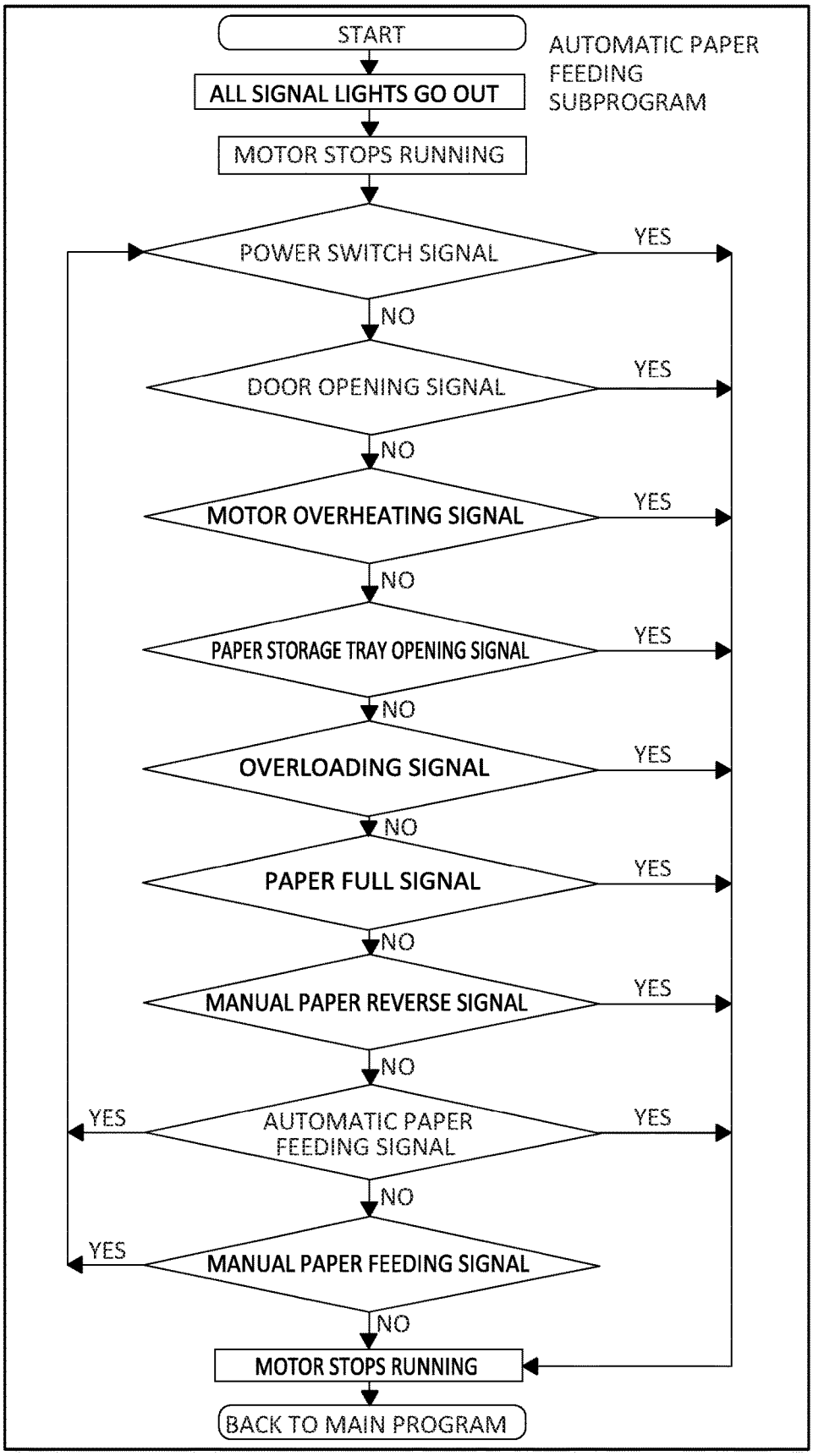
FIG. 23 is a flow chart for the logic of the shredder Automatic Paper Feed subprogram, in accordance with the teachings of the present invention.

In FIG. 12, an embodiment of Main program 1200 is illustrated. In the current embodiments of main program 1200, received signals can trigger operation of corresponding subprograms, which are executed when the respective signal is received. For example, if Power Switch signal 1205 is received, then autofeed shredder 100 enter operation of the power switch subprogram 1207 (FIG. 13). If wastebin 150 Door Open signal 1210 is received, then autofeed shredder 100 enters operation of wastebin 150 Door Open subprogram 1212 (FIG. 14). If Motor Overheating signal 1215 is received, then autofeed shredder 100 enters operation of Motor Overheating subprogram 1217 (FIG. 15). If Storage Tray Open signal 1220 is received, then autofeed shredder 100 enters operation of Storage Tray Open subprogram 1222 (FIG. 16). If Overload signal 1225 is received, then autofeed shredder 100 enters operation of Overload subprogram 1227 (FIG. 17). If Paper Full signal 1230 is received, then autofeed shredder 100 enters operation of paper full subprogram 1232 (FIG. 18). If Auto/Manual Paper Reverse mode signal 1235 is received, then autofeed shredder 100 enters operation of Auto/Manual Paper Reverse subprogram 1237, with or without PAE signal (FIG. 19). If Auto/Manual Paper Forward Feed signal 1240 is received, then autofeed shredder 100 enters operation of Auto/Manual Paper Forward Feed subprogram 1242, with or without PAE signal (FIG. 20). If Storage Tray Feeding Error signal 1245 is received, then autofeed shredder 100 enters operation of Storage Tray Feeding Error subprogram 1247 (FIG. 21). If Safety Lock signal 1250 is received, then autofeed shredder 100 enters operation of Safety Lock subprogram 1252 (FIG. 22). If Automatic Paper Feed signal 1255 is received, then autofeed shredder 100 enters operation of Automatic Paper Feed subprogram 1257 (FIG. 23). If Delay Feed signal 1060 is received, then autofeed shredder 100 enters operation of the Delay Feed subprogram 1062 (FIG. 24).

In FIG. 13, an embodiment of Power Switch subprogram 1207 is illustrated. When Power Switch subprogram 1207 is executed, the status of the power switch is checked. If the power switch of autofeed shredder 100 is set to OFF, signal lights go out and shredder motor 108 stops running. If Power Switch signal 1205 is received (power switch set to ON), then the power switch light illuminates and control returns to main program 1200.

In FIG. 14, an embodiment of Door Open subprogram 1207 is illustrated. When Door Open subprogram 1212 is executed, opening the shredder wastebin door 151 results in a signal 1210 that extinguishes all signal lights except for the power light, door open signal light illuminates and shredder motor 108 stops running. The Door Open signal light remains illuminated unless Power Switch signal 1205 is OFF, in which case Door Open signal light extinguishes, and control returns to main program 1200. If Power Switch signal 1205 is ON and Door Open signal 1210 is OFF, Door Open signal is extinguished, and control returns to main program 1200.

In FIG. 15, an embodiment of Motor Overheating subprogram 1217 is illustrated. Motor Overheating subprogram 1217 is executed when Motor Overheating signal 1215 is received. In this case, all of the signal lights go out except for the Power signal light, the Motor Overheating signal light goes on, and motor 108 stops running. If Power Switch signal 1205 is OFF, or the Door Open signal 1210 is cleared, the Motor Overheating signal light goes out, and control returns to main program 1200. Otherwise, control waits for the Motor Overheating signal 1215 to clear. When this occurs, the Motor Overheating signal 415 light goes out and control is returned to main program 1200.

In FIG. 16, an embodiment of Paper Storage Tray Open subprogram 1222 is illustrated. Paper Storage Tray Open subprogram 1222 is executed when Paper Storage Tray Open signal 1220 is received, by initially turning off all signal lights except for the Power signal light, and stopping shredder motor 108 from running. If Power Switch signal 1205 is OFF, Door Open signal 1210, or Motor Overheating signal 1215 is received, then control is returned to main program 1200. If Power Switch signal 1205, Door Open signal 1210, and Motor Overheating signal 1215 are not received, then paper storage tray opening signal 420 presence is awaited by shifting control over to Power Switch signal 405 step. If the signal clears and is not received, then control returns to Main Program 1200.

In FIG. 17, an embodiment of Overload subprogram 1227 is illustrated. If Overload subprogram 1227 is entered by receiving Overload signal 1225, then all signal lights go out except for the Power signal light, the Overload signal light illuminates, and shredder motor 108 stops running. Then the shredder feed automatically reverses paper feed for a predetermined period, without limitation, about 2.5 seconds, to clear the overload. Once about 2.5 seconds has transpired, then control returns to Main Program 1200. Of course, longer or shorter periods for feed reversal are contemplated.

In FIG. 18, an embodiment of Paper Full subprogram 1232 is illustrated. If wastebin 150 is full, then Paper Full signal 1230 is issued. When Paper Full signal 1230 is received then paper full subprogram 1232 is executed by extinguishing all signal lights except for the Power signal light, the Paper Full signal light illuminates, and motor 108 stops running. If Power Switch signal 1205 is set to OFF, and Door Open signal 1210, Motor Overheating signal 1215, or Storage Tray Open signal 1220 is received, Paper Full signal 1230 is extinguished, and control returns to Main Program 1200. Otherwise, if Power Switch signal 1205 is set to ON, and Door Open signal 1210, Motor Overheating signal 1215, and Storage Tray Opening signal 1220 are not received, then Paper Full signal 1230 is extinguished, and control returns to Main Program 1200.

In FIG. 19, an embodiment of Auto/Manual Paper Reverse Feed mode subprogram 1237 is illustrated. If Auto/Manual Paper Reverse Feed mode signal 1235 is received, then Auto/Manual Paper Reverse Feed mode subprogram 1237 is executed. Initially, all signal lights except for the Power signal light are extinguished. Then shredder motor 108 will begin to reverse the paper feed. If the Power Switch signal 1205 is ON, and Door Open signal 1210, Motor Overheating signal 1215, Paper Storage Tray Open signal 1220, Overload signal 1225, or Auto/Manual Paper Forward Feed mode signal 1240 is received, then shredder motor 108 stops working and the control returns to Main Program 1200. If Power Switch signal 1205 is OFF, or Door Open signal 1210, Motor Overheating signal 1215, Paper Storage Tray Open signal 1220, Overload signal 1225, Auto/Manual Forward Feed mode signal 1240, or Auto/Manual Paper Reverse mode signal 1235 are received then shredder motor 108 stops, and control is returned to Main Program 1200.

In FIG. 20, an embodiment of Auto/Manual Paper Forward Feed mode subprogram 1242 is illustrated. If paper is inserted through auto/manual feed slot 122, then Auto/Manual Paper Forward Feed signal mode 1240 is issued. When Auto/Manual Paper Forward Feed signal mode signal 1240 is received, then Auto/Manual Paper Forward Feed signal mode subprogram 1242 is entered. Initially, all the signal lights go out except for the Power indicator light, and motor 108 operates to feed the paper into shredder blades 110. If a Power Switch signal 1205 is set to OFF, or Door Open signal 1210, Overheating signal 1215, Paper Storage Tray Open signal 1220, Overload signal 1225, Paper Full signal 1230, or Auto/Manual Paper Reverse Feed mode signal 1235 is received, then shredder motor 108 stops running and control returns to Main Program 1200. Otherwise, if a Power Switch signal 1205 is set to ON, and a Door Open signal 1210, Motor Overheating signal 1215, Paper Storage Tray Open signal 1220, Overload signal 1225, Paper Full signal 1230, and Auto/Manual Paper Reverse Feed mode signal 1235 are not received, and Auto/Manual Paper Forward Feed signal 1240 terminates, then shredder motor 108 stops running, and control passes to Main Program 1200.

In FIG. 21, an embodiment of Storage Tray Feeding Error subprogram 1247 is illustrated. Storage Tray Feeding Error signal 1245 initiates Paper Storage Tray Feeding Error subprogram 1247, in which initially, all signal lights are extinguished except for the Power signal light. Storage Tray Feeding Error signal 1245 light illuminates. If Power Switch signal 1205 is OFF or Door Open signal 1210, Motor Overheating signal 1215, Paper Storage Tray Open signal 1220, Paper Full signal 1230, or Auto/Manual Paper Reverse Feed mode signal 1235 is received, then Paper Storage Tray Feeding Error signal light extinguishes, and control is returned to Main Program 1200. When the Paper Storage Tray Feeding Error signal 1245 clears, then Paper Storage Tray Feeding Error signal light extinguishes, and control is returned to Main Program 1200.

In FIG. 22, an embodiment of Safety Lock subprogram 1252 is illustrated. Safety Lock signal 1250 initiates the Safety Lock subprogram 1252, where shredder motor 108 stops running. Then, if Power Switch signal 405 is set to OFF, or Door Open signal 1210, Motor Overheating signal 1215, Paper Storage Tray Open signal 1220, Paper Full signal 1230, Auto/Manual Paper Reverse Feed mode signal 1235, or Auto/Manual Paper Forward Feed mode signal 1240 is received, the Safety Lock light goes out and control returns to Main Program 1200. Otherwise, if Power Switch signal 1205 is set to ON and Door Open signal 1210, Motor Overheating signal 1215, Paper Storage Tray Open signal 1220, Paper Full signal 1230, Auto/Manual Paper Reverse Feed mode signal 1235 and Auto/Manual Paper Forward Feed mode signal 1240 are not received, and the Paper at Entry Point signal (PAE) or Paper Storage Tray Open signal 1220 is not received, then the Safety Lock light goes out and control returns to Main Program 1200.

In FIG. 23, an embodiment of Automatic Paper Feeding subprogram 1257 is illustrated. If Automatic Paper Feeding signal 1255 is received, then Automatic Paper Feeding subprogram 1257 is initiated, where, initially, all signal lights go out except for the POWER indicator light, and shredder motor 108 stops running. If Power Switch signal 1205 is set to ON, and Door Open signal 1210, Motor Overheating signal 1215, Storage Paper Tray Open signal 1220, Overload signal 1225, Paper Full signal 1230, or Auto/Manual Paper Reverse Feed mode signal 1235 is received, then shredder motor 108 stops running and control returns to Main Program 1200. If Power Switch signal 1205 is set to OFF, and Door Open signal 410, Motor Overheating signal 1215, Storage Paper tray opening signal 1220, Overload signal 1225, Paper Full signal 1230, Auto/Manual Paper Reverse Feed mode signal 1235, Automatic Paper Feeding signal 1255 and Auto/Manual Paper Forward Feed mode signal 1240 are not received, then shredder motor 108 stops running and control returns to Main Program 1200.

In FIG. 24, an embodiment of Delay Paper Feed subprogram 1262 is illustrated. Delay Paper Feeding subprogram 1262 is started upon receipt of Delay Paper Feeding signal 1260, where, initially, all signal lights go out except for the POWER indicator light, and shredder motor 108 begins feeding paper. If Power Switch signal 1205 is set to OFF, or Door Open signal 1210, Motor Overheating signal 1215, Storage Paper Tray Open signal 1220, Overload signal 1225, Paper Full signal 1230, Auto/Manual Paper Reverse Feed mode signal 1235, Automatic Paper Feeding signal 1255 or Auto/Manual Paper Forward Feed mode signal 1240 is received, then shredder motor 108 stops running and control is returned to Main Program 1200. If Automatic Paper Feed signal 1255 or Auto/Manual Paper Forward Feed mode signal 1240 is received, then control transfers directly to Main Program 1200. If Power Switch signal 1205 is set to ON, and Door Open signal 1210, Motor Overheating signal 1215, Storage Paper Tray Open signal 1220, Overload signal 1225, Paper Full signal 1230, Auto/Manual Paper Reverse Feed mode signal 1235, Automatic Paper Feed signal 1255 and Auto/Manual Paper Forward Feed mode signal 1240 are not received, and the shredder logic reaches a preselected time delay, shredder motor 108 stops running and control returns to Main Program 1200.

FIG. 25 illustrates floor plan with quadrants of circuits for schematic 2500 in FIGS. 25A-D. FIGS. 25A-25D together illustrate an embodiment of schematic 2500 for autofeed paper shredder 100. In FIG. 25, quadrant 25A of the floor plan represents the circuits of schematic 2500 in FIG. 25A, quadrant 25B of the floor plan represents the circuits of schematic 2500 shown in FIG. 25B, quadrant 25C of the floor plan represents the circuits of schematic 2500 shown in FIG. 25C, and quadrant 25D of the floor plan represents the circuits of schematic 2500 shown in FIG. 25D. TABLE 1 provides a recitation of relevant pin connections from/to CPU 2538 in FIG. 25D and to/from relevant circuit connections in FIGS. 25A-D, assuming a PIC18F4450 PIC processor is used.

TABLE 1

| CPU Pin Ref./Signal/Signal Ref. No. | | |
|---|---|---|
| RC5 | k_output | 2550 |
| RC4 | k_power | 2552 |
| RD3 | k_input | 2554 |
| RD2 | l_power | 2556 |
| RD1 | l_hot | 2558 |
| RD0 | l_full | 2560 |
| RC3 | l_overload | 2562 |
| RC2 | l_door | 2564 |
| RC1 | l_error | 2566 |
| RE2 | jac | 2568 |
| RE1 | board | 2570 |
| RE0 | door | 2572 |
| RA5 | jdc | 2574 |
| RA4 | overload | 2576 |
| RA3 | paper | 2578 |
| RA2 | full | 2580 |
| RA1 | in | 2582 |
| RA0 | hot | 2584 |
| RE3 | mclr | 2586 |
| RB7 | dat | 2588 |
| RB6 | clk | 2590 |
| RB2 | input cps2 | 2592 |
| RB1 | power cps1 | 2594 |
| RB0 | output cps0 | 2596 |

The first column represents a pinout location on an example of CPU 2538 (PIC18F4450 PIC processor). The second column identifies the corresponding circuit signal identifier. The third column identifies the corresponding reference numbers in FIG. 25A-25D, which can identify CPU connections with respective parts of the circuitry.

Figure 25A:
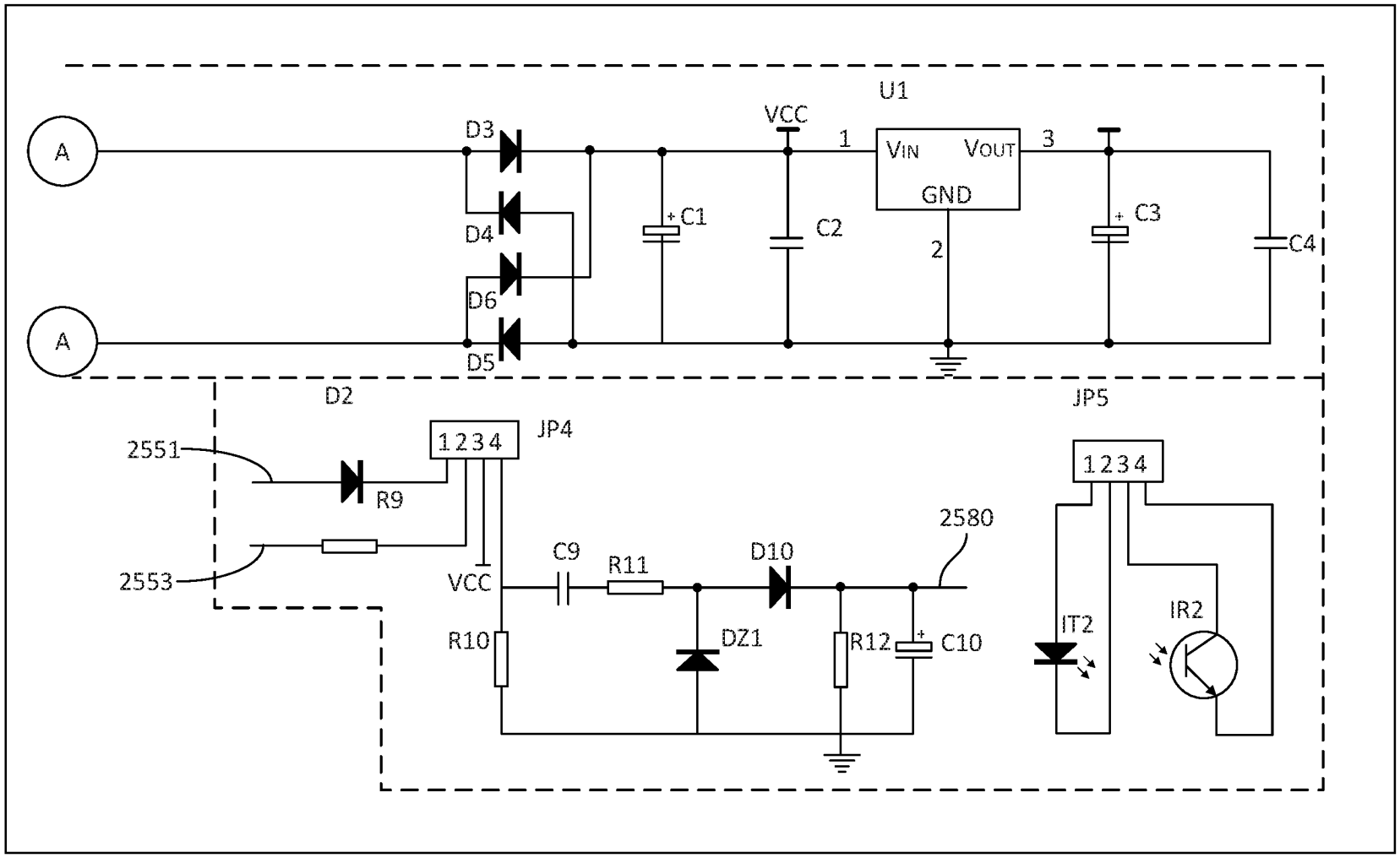
FIG. 25A is a first quadrant of a schematic for an autofeed paper shredder, in accordance with the teachings of the present invention.

FIG. 25A illustrates a BIN FULL circuit 2502 and the first portion of a POWER circuit 2504. BIN FULL circuit 2502 includes photodetector 2506, which may be an LED transmitter/sensor detector, and which can be disposed in, or proximate to, wastebin 150. When wastebin 150 is not full, photodetector 2506 is disposed in a quiescent state. When wastebin 150 becomes full, a Paper Bin Full signal 2580 may be generated by photodetector 2506. The first portion of POWER circuit 2504 can include a rectifier circuit 2508, which converts a stepped-down AC input into a DC voltage with ripple. The stepped-down AC input received at A-A from the second portion of the POWER circuit 2504 in FIG. 25B. Voltage regulator 2510 removes at least a portion of the ripple to provide regulated 5 VDC.

Figure 25B:
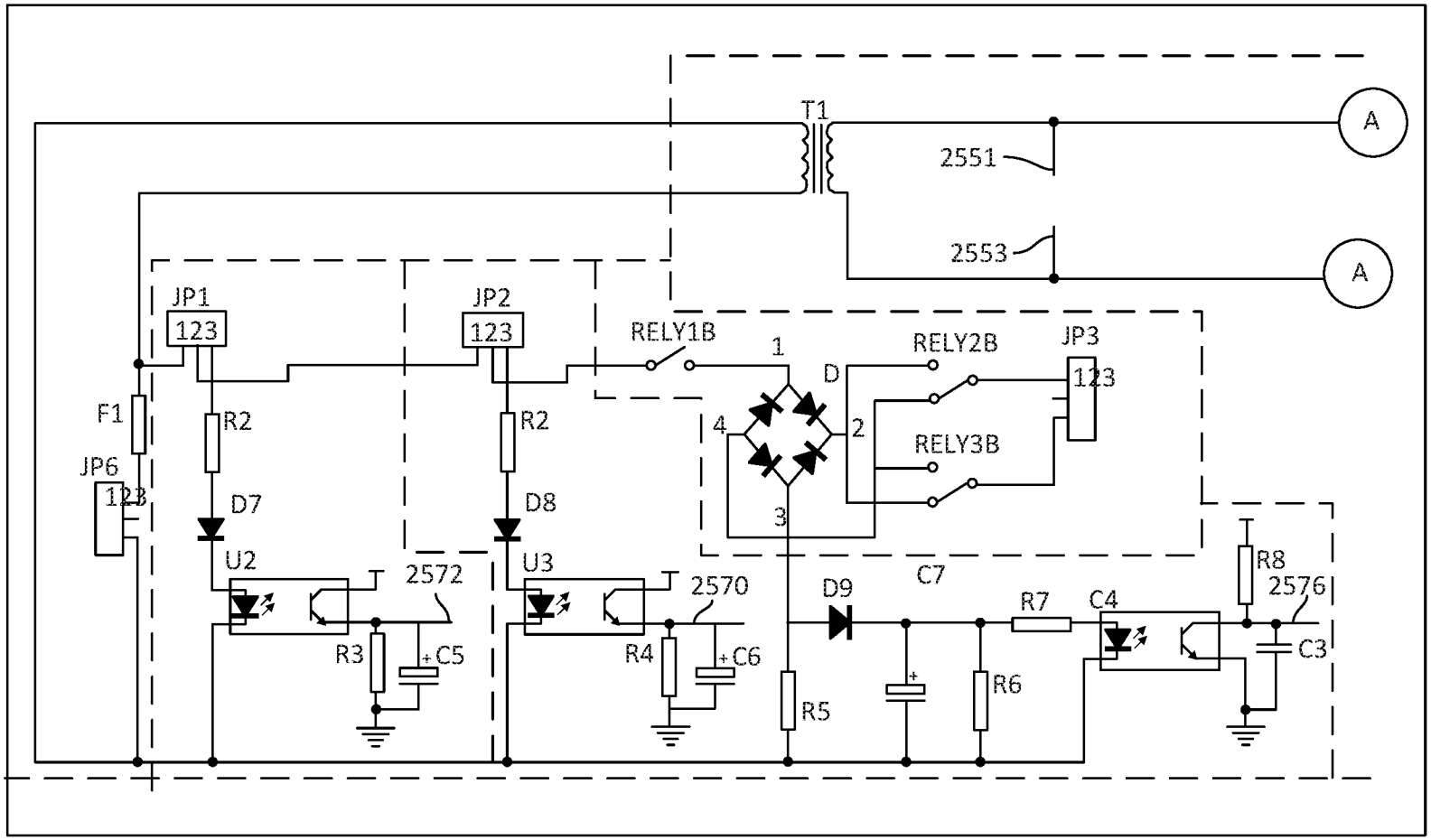
FIG. 25B is a second quadrant of the schematic for an autofeed paper shredder, in accordance with the teachings of the present invention.

FIG. 25B illustrates a DOOR OPEN detection circuit 2512, a COVER OPEN/CLOSED detection circuit 2514, an OVERLOAD detection circuit 2516, a RELAYS circuit 2518, and the second portion of a POWER circuit 2504. DOOR OPEN detection circuit 2512 can detect the wastebin door 151 open, using a photodetector 2514, which may be an LED transmitter/sensor detector. When the door 151 of wastebin 150 is closed, photodetector 2514 can be disposed in a quiescent state. When the door 151 of wastebin 150 is opened, photodetector 2514 causes a DOOR OPEN signal ("door") 2572 to be generated. COVER OPEN/CLOSED detection circuit 2514 can generate a COVER OPEN signal 2570 ("board"), which also can produce a Safety Lock signal 1250. OVERLOAD detection circuit 2516, can include photodetector 2520, which can produce Overload signal ("overload") 2576, when an overload situation is sensed (e.g., operating motor becomes jammed). RELAYS circuit 2518 contains the switching relays used to provide the POWER ON/OFF (RELAY 1B) and rotation direction control of shredder motor 108 (RELAY 2B and 3B). The second portion of a POWER circuit 2504 can receive mains AC which is coupled to the POWER ON/OFF switch. Transformer 2522 can be employed to provide stepped-down AC input to connections A-A, which couples to the first portion of the POWER circuit in FIG. 25A, and to signal point connections AC1 2551, and AC2 2553. POWER circuit 2504 may be protected from overcurrent conditions by a fuse (F1).

Figure 25C:
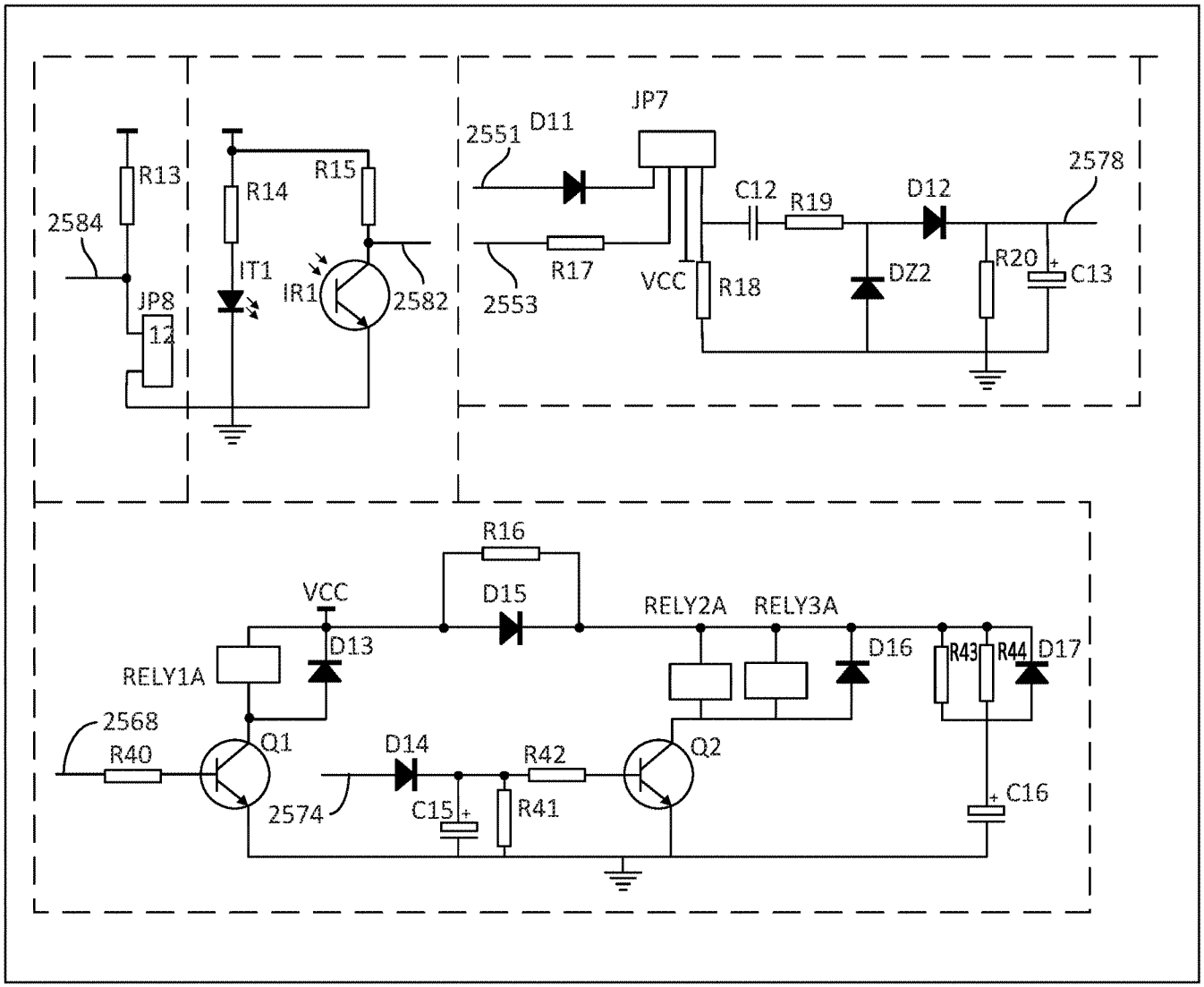
FIG. 25C is a third quadrant of the schematic for an autofeed paper shredder, in accordance with the teachings of the present invention.

FIG. 25C illustrates OVERHEATING circuit 2524, MANUAL FEED AUTOSTART sensor and AUTO-FEED paper detection circuit 2526, PAPER IN TRAY detection circuit 2528, and RELAY CONTROL circuit 2530. OVERHEATING circuit 2524 may be a simple resistive detector coupled to shredder motor 108, which produces Motor Overheating signal ("hot") 2584. MANUAL FEED AUTOSTART sensor and AUTO-FEED paper detection circuit 2526 (sensor 132) provides paper at the entry of feed slot 136 signal ("in") 2582. If paper is detected, then paper-at-entry (PAE aka "in") signal 2582 may be generated and transmitted to the CPU 2538, causing shredder motor 108 to start. Depending upon the selected mode of the shredder (Auto Feed/Manual Feed) as selected with TOUCH BUTTON CONTROL circuit 2534, CPU 2538 may send a Manual Paper Feed signal 1240 or an Automatic Paper Feed signal 1255. In either mode, shredding may be initiated such that, even in Manual Feed mode, shredder motor 108 can be turned on automatically, upon receipt of the PAE signal 2582. PAPER IN TRAY detection circuit 2528, sensor 130 may use a capacitive sensor to detect paper in the paper tray 140, which may use a change in capacitance in the sensor to indicate when paper is present ("paper") 2578. RELAY CONTROL circuit 2530 can be configured to use AC signal ("jac") 2568 to control the POWER ON/OFF relay (RELY1A) and a DC signal ("jdc") 2574 to control the rotational direction of shredder motor 108 (RELY 2A and 3A).

Figure 25D:
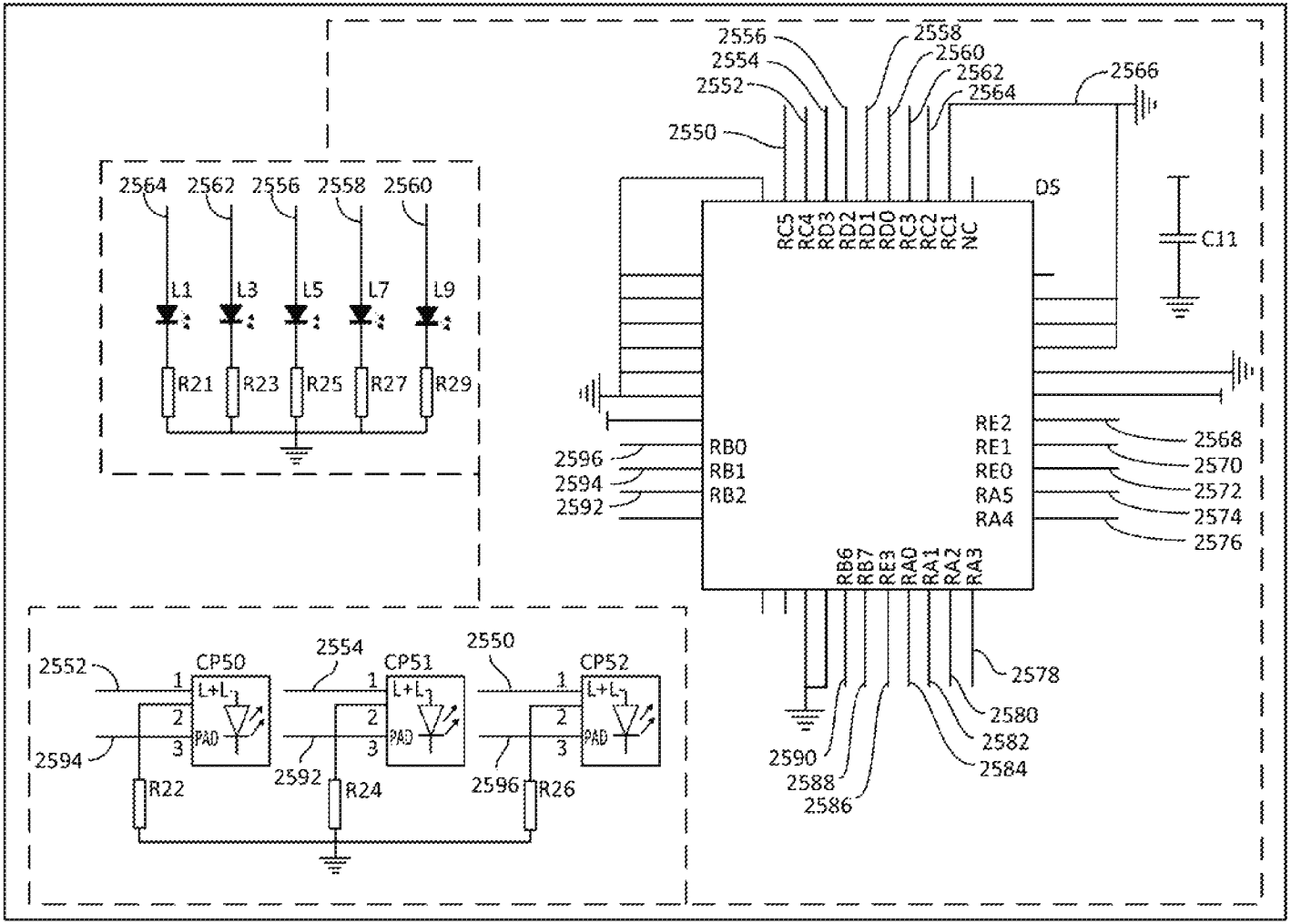
FIG. 25D is a fourth quadrant of the schematic for an autofeed paper shredder, in accordance with the teachings of the present invention.

FIG. 25D illustrates INDICATOR LIGHTS circuit 2532, TOUCH BUTTON CONTROL circuit 2534, and PROCESSOR circuit 2536, including the central processing unit (CPU) 2538. The INDICATOR LIGHTS circuit 2532 can include DOOR OPEN indicator light ("l_door") 2564, OVERLOAD indicator light ("l_overload") 2562, POWER indicator light ("l_power") 2556, OVERHEAT indicator light ("l_hot") 2558 and PAPER FULL indicator light ("l_full") 2560. These indicator lights can be respectively illuminated when the associated conditions are sensed and respective signals are generated. More or fewer indicator lights may be used in other embodiments.

TOUCH BUTTON CONTROL circuit 2534 changes the function or mode of autofeed shredder 100 by a user (not shown) pressing one or more of the buttons. More or fewer touch buttons may be used. Touch buttons may be capacitive touch buttons. Button CPS0 is representative of a power on/off button, receiving power signal 2552 ("k power") and outputting signal 2594 ("power cps0") to CPU 2538. Button CPS1 can be representative of a first mode button receiving input signal 2554 ("k input") and outputting signal 2592 ("input cps2") to CPU 2538. Button CPS3 can receive signal 2550 ("k output") and output signal 2596 ("output cps2") to CPU 2538. Other embodiments may use more, fewer, or other touch buttons.

PROCESSOR circuit 2536 includes CPU 2538. CPU 2538 can be a 44-pin, QFN package, PIC18F4450 PIC processor, available from Microchip Technology, Inc., Chandler, Ariz. USA. CPU 2538 also can be provided as an alternative processor, including, without limitation, a PIC16F1934. Other circuit connections and provisions are contemplated without detracting from the spirit of the embodiments herein.

The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law. Moreover, it is noted that like reference numerals represent similar parts throughout the several views of the drawings, although not every figure may repeat each and every feature that has been shown in another figure in order to not obscure certain features or overwhelm the figure with repetitive indicia. It is understood that the invention is not limited to the specific methodology, devices, apparatuses, materials, applications, etc., described herein, as these may vary. It is also to be understood that the terminology used herein is used for the purpose of describing particular embodiments only, and is not intended to limit the scope of the invention.

What is claimed is:

1. A paper shredder having counter-rotating shredder blades coupled to a shredder motor, the paper shredder comprising:

a paper tray having a floor, the paper tray being shaped to receive paper;

the floor having an offset slot therein adjacent to the counter-rotating shredder blades;

engagement wheels partly protruding through the floor adjacent to the offset slot, the engagement wheels configured to frictionally engage paper, to turn towards the offset slot, and to force the paper into the counter-rotating shredder blades; and a dentate catch disposed on the floor in a paper tray corner, the dentate catch having integral dentate catch teeth arranged in a horizontal plane with and pointing away from the slot, and the integral dentate catch teeth configured to temporarily hold an affixment while a sheet of paper, held by the affixment, is frictionally engaged by the engagement wheels to enter the offset slot and to be comminuted by the counter-rotating shredder blades and wherein the dentate catch is in communication with a wastebin such that a captured affixment falls into the wastebin after being removed from the sheet of paper.

2. The shredder of claim 1, further comprising:

a paper-in-tray sensor disposed in the floor, configured so that when paper is disposed adjacent to the paper-in-tray sensor, the shredder motor is configured to turn the engagement wheels and the counter-rotating shredder blades in the forward direction.

3. The shredder of claim 2, further comprising:

a paper-at-entry sensor disposed perpendicularly to a longitudinal axis of the offset slot, the paper-at-entry sensor being a photodiode configured so that when paper is adjacent to the photodiode, the shredder motor turns the engagement wheels, and the counter-rotating shredder blades in the forward direction thereby moving the paper through the slot and into the counter-rotating shredder blades.

4. The paper shredder of claim 1, further comprising an integral dentate catch disposed in two corners of the paper tray floor, the integral dentate catch configured to temporarily hold an affixment while a sheet of paper in the paper tray held by the affixment is being frictionally engaged by the engagement wheels to enter the slot for comminution by the counter-rotating shredder blades.

5. The paper shredder of claim 1, further comprising a cover formed to cover the paper tray.

6. The paper shredder of claim 5, further comprising:

a cover open/closed sensor positioned to detect when the cover is closed on the paper tray.

7. The paper shredder of claim 1, wherein the floor of the paper tray is sloped at a vertical angle.

8. The paper shredder of claim 7, further comprising two pairs of dentate catches disposed in each of the corners of the paper tray, the dentate catches having teeth oriented away from the offset slot.

9. A paper shredder having a shredder motor and counter-rotating shredder blades coupled to the shredder motor, the paper shredder comprising:

a paper tray having a floor, the paper tray being shaped to receive paper, the floor being vertically sloped;

the floor having an offset slot adjacent to the counter-rotating shredder blades;

engagement wheels partly protruding into floor, adjacent to the offset slot, the engagement wheels configured to frictionally engage paper into the offset slot;

a paper-in-tray sensor disposed in the floor, configured so that when the paper is adjacent to the paper-in-tray sensor, the shredder motor activates the engagement wheels to turn in the direction of the offset slot; and a plurality of dentate catches disposed on the floor of and in corners of the paper tray, each of the plurality of dentate catches having integral teeth pointing away from the offset slot, and the dentate catch teeth configured to catch and temporarily hold an affixment while an associated sheet of paper is being engaged by the engagement wheels for shredding.

10. The paper shredder of claim 9, further comprising:

a paper-at-entry sensor disposed adjacent to the offset slot, the paper-at-entry sensor configured so that when paper is detected by the paper-at-entry sensor, the engagement wheels are activated to turn in the direction of the offset slot, frictionally engaging the paper; and a cover configured to cover the paper tray and including a cover slot in alignment with the offset slot, wherein the paper-at-entry sensor is configured to detect paper entered into the cover slot.

11. The paper shredder of claim 9, further comprising:

a cover formed to cover the paper tray; and a cover open/closed sensor positioned to detect when the cover is closed on the paper tray, allowing the paper shredder to operate.

12. The paper shredder of claim 9, further comprising:

a wastebin beneath the paper tray; and a PAPER FULL sensor coupled to the wastebin and configured to prevent the shredder motor from operating when the wastebin is full.

13. The paper shredder of claim 12, further comprising:

a wastebin door coupled to the wastebin; and a DOOR OPEN sensor coupled to the wastebin door and configured to allow the shredder motor to operate when the wastebin door is closed.

14. The paper shredder of claim 9, further comprising:

an OVERLOAD sensor coupled to the motor, the OVERLOAD sensor configured to cause the shredder motor to operate in a reverse direction for a predetermined time.

15. The paper shredder of claim 9, further comprising:

an OVERHEAT sensor coupled to the motor, the OVERHEAT sensor configured to turn off the shredder motor when the OVERHEAT sensor detects an overheating condition in the shredder motor.

16. A paper shredder having a shredder motor coupled to counter-rotating blades, the paper shredder comprising:

a paper tray having a floor, the paper tray being shaped to receive paper, the floor being obtusely vertically sloped;

the floor having an offset slot adjacent to the counter-rotating shredder blades;

engagement wheels partly protruding into floor, adjacent to the offset slot, the engagement wheels configured to frictionally engage paper into the offset slot;

a paper-in-tray sensor disposed in the floor, configured so that when the paper is adjacent to the paper-in-tray sensor, the engagement wheels are activated to turn in the direction of the offset slot;

a plurality of integral dentate catches disposed in corners of the paper tray floor, each of the plurality of integral dentate catches having integral dentate catch teeth pointing away from the offset slot, the dentate catch teeth configured to temporarily hold an affixment while an associated sheet of paper is being engaged by the engagement wheels and removed from the affixment for shredding;

a paper-at-entry sensor disposed adjacent to the offset slot, the paper-at-entry sensor configured so that when paper is detected by the paper-at-entry sensor, the engagement wheels are activated to turn in the direction of the offset slot, frictionally engaging the paper and forcing it into the offset slot;

a cover configured to cover the paper tray and including a cover slot in alignment with the offset slot, wherein the paper-at-entry sensor is configured to detect paper entered into the cover slot;

a cover open/closed sensor positioned to detect when the cover is closed on the paper tray, allowing the paper shredder to operate;

a wastebin beneath the paper tray;

a PAPER FULL sensor coupled to the wastebin and configured to prevent the paper shredder from operating when the wastebin is full;

a wastebin door coupled to the wastebin;

a DOOR OPEN sensor coupled to the wastebin door and configured to allow the paper shredder to operate when the wastebin door is closed;

an OVERLOAD sensor coupled to the shredder motor, the OVERLOAD sensor configured to cause the motor to operate in a reverse direction for a predetermined time; and an OVERHEAT sensor coupled to the motor, the OVERHEAT sensor configured to turn off the motor when the OVERHEAT sensor detects an overheating condition in the motor.

17. The paper shredder of claim 16, further comprising a PAPER STORAGE TRAY FEEDING ERROR sensor coupled to the motor, the PAPER STORAGE TRAY FEEDING ERROR sensor configured to turn off the motor when the PAPER STORAGE TRAY FEEDING ERROR sensor detects a paper storage tray feeding error.

18. The Paper shredder of claim 16, further comprising a SAFETY LOCK signal which, when initiated, turns off the motor.

* * * * *